US009481200B2

(12) United States Patent
Ward et al.

(10) Patent No.: US 9,481,200 B2
(45) Date of Patent: Nov. 1, 2016

(54) EMBOSSING SYSTEM

(75) Inventors: James R. Ward, Naperville, IL (US); Mark B. Richardson, Joliet, IL (US); Anthony G. Smith, Sr., Lemont, IL (US)

(73) Assignee: Panduit Corp., Tinley Park, IL (US)

( * ) Notice: Subject to any disclaimer, the term of this patent is extended or adjusted under 35 U.S.C. 154(b) by 1216 days.

(21) Appl. No.: 13/030,226

(22) Filed: Feb. 18, 2011

(65) Prior Publication Data

US 2011/0217149 A1 Sep. 8, 2011

Related U.S. Application Data

(60) Provisional application No. 61/310,149, filed on Mar. 3, 2010.

(51) Int. Cl.
*B44B 5/02* (2006.01)

(52) U.S. Cl.
CPC ..... *B44B 5/024* (2013.01)

(58) Field of Classification Search
USPC ..... 221/208, 210, 224–226, 231
See application file for complete search history.

(56) References Cited

U.S. PATENT DOCUMENTS

| | | | | |
|---|---|---|---|---|
| 2,833,386 | A | | 5/1958 | Hueber |
| 4,255,073 | A | | 3/1981 | Schöttle |
| 4,441,831 | A | | 4/1984 | Tipple et al. |
| 4,961,566 | A | * | 10/1990 | Labombarde ..... 271/35 |
| 5,503,514 | A | | 4/1996 | LaManna et al. |
| 5,542,571 | A | * | 8/1996 | Belka ..... 221/268 |
| 5,549,218 | A | * | 8/1996 | Asmussen ..... 221/282 |
| 5,642,877 | A | * | 7/1997 | Green ..... 271/35 |
| 5,647,507 | A | | 7/1997 | Kasper |
| 5,785,436 | A | | 7/1998 | Harrison et al. |
| 6,264,195 | B1 | | 7/2001 | Hoberock et al. |
| 7,344,325 | B2 | * | 3/2008 | Meier et al. ..... 400/208 |
| 7,458,574 | B2 | | 12/2008 | Wilcox et al. |
| 7,559,547 | B2 | | 7/2009 | Van Dongen et al. |
| 7,919,060 | B2 | * | 4/2011 | Funke et al. ..... 422/500 |
| 2002/0060223 | A1 | * | 5/2002 | O'Brien ..... 221/73 |
| 2008/0267686 | A1 | | 10/2008 | Blanks |
| 2009/0001095 | A1 | | 1/2009 | Yamamiya |

FOREIGN PATENT DOCUMENTS

FR 2677330 A1 12/1992

* cited by examiner

*Primary Examiner* — Gene Crawford
*Assistant Examiner* — Kelvin L Randall, Jr.
(74) *Attorney, Agent, or Firm* — Christopher S. Clancy; James H. Williams; Aimee E. McVady

(57) ABSTRACT

A marker plate embossing system is provided having an improved loading device, and improved chute and hopper systems. The loading device reduces the likelihood of marker plate misfeed. The chute and hopper systems allow the embossing of varying sized embossing plates, while reducing the likelihood of embossed marker plates being delivered in an incorrect stacked-order. A marker plate removal system is also provided for removing embossed marker plates from the hopper system without the marker plates falling out of the stacked-order.

14 Claims, 17 Drawing Sheets

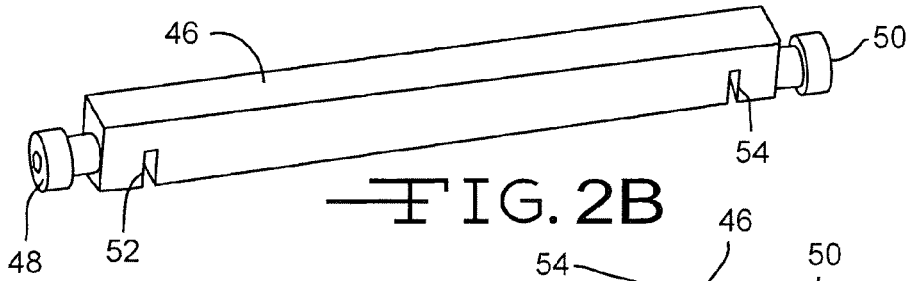
FIG. 2B
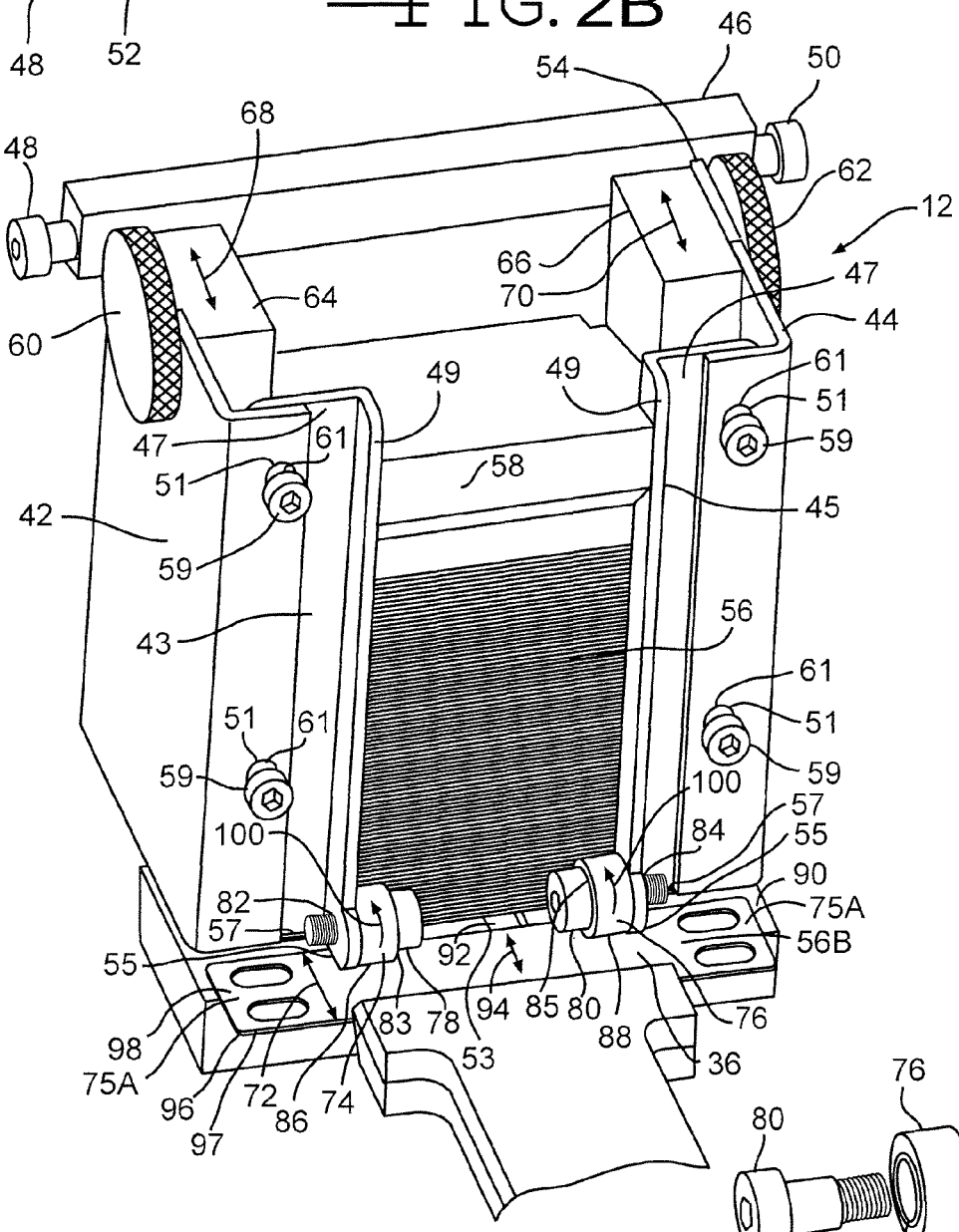
FIG. 2
FIG. 2F

EMBOSSING SYSTEM

CROSS-REFERENCE TO RELATED APPLICATIONS

This Utility Application claims priority to U.S. Provisional Patent Application Ser. No. 61/310,149 filed Mar. 3, 2010, entitled "Embossing System", which is hereby incorporated by reference in its entirety.

FIELD OF THE DISCLOSURE

This disclosure relates to improvements in embossing systems. More specifically, the disclosure relates to an embossing system having an improved loading device, an improved chute, and an improved hopper.

BACKGROUND OF THE DISCLOSURE

Embossing systems may be used to emboss markings into marker plates typically made of metal. One such embossing system is the PANDUIT® PES197 portable embossing system. This embossing system uses a loading device to load stacked marker plates, one at a time, to a delivery device which sequentially delivers each marker plate of the stack to an embossing device. The loading device comprises opposed frame and gate members which hold the stacked marker plates between the frame members. A plate weight is disposed on top of the stacked marker plates. A marker plate moving member moves one marker plate at a time out of the bottom of the stack onto a base-surface disposed adjacent to the gate members. Occasionally, the marker plate moving member may misfeed resulting in more than one marker plate being pushed out of the stack onto the base-surface, or marker plates becoming stuck between the gate members and the base-surface. This may result in the embossing system having to be stopped to reset the loading device. Additionally, on occasion, the frame members and gate members may be bumped out of alignment due to excessive vibration in the embossing system, or due to the loading of marker plates into the loading device. This may cause one or more of the following: marker plates scraping against the frame members and gate members; marker plates becoming lodged between the gate members; more than one marker plate being pushed out of the stack onto the base-surface; and marker plates becoming stuck between the gate members and the base-surface.

After each sequential marker plate is embossed by the embossing device, the delivery device drops each sequential embossed marker plate, one at a time, into a chute located within the housing of the embossing system. The chute drops each sequential embossed marker plate, one at a time, into a hopper located outside of the embossing system. The embossed marker plates are gathered one at a time in the hopper to form a stacked arrangement in the hopper. It is desirable for the stacked arrangement of embossed marker plates within the hopper to be identical to the stacked arrangement of marker plates within the loading device prior to the marker plates having been embossed. However, on occasion, as an embossed marker plate drops into the chute or into the hopper, the embossed marker plate may hit the bottom surface of the chute or the hopper at a speed or orientation which causes the embossed marker plate to flip over. This may undesirably result in the stacked arrangement of embossed marker plates in the hopper varying from the stacked arrangement of the marker plates in the loading device prior to being embossed.

When inserts are installed in the chute and the hopper, the chute and the hopper may accommodate marker plates having a width of 0.95 centimeters (0.37 inches). When inserts are not installed in the chute and the hopper, the chute and the hopper may accommodate marker plates having a width of 1.905 centimeters (0.75 inches). The chute and the hopper are not able to accommodate marker plates having any other widths.

As the embossed stacked marker plates are removed from the hopper, on occasion, the embossed stacked marker plates may fall out of their stacked arrangement. This is undesirable.

Improvements in the embossing system are needed to reduce or eliminate one or more of the identified issues.

SUMMARY OF THE DISCLOSURE

In one aspect of the disclosure, a loading device for a marker plate embossing system is provided. The loading device includes a base surface, gate members, and rollers attached to the gate members. The rollers are disposed adjacent to the base surface.

In another aspect of the disclosure, a chute system for a marker plate embossing system is provided. The chute system includes a chute and a plurality of varying sized members. The chute includes opposed side-walls forming a first trough-like opening between the opposed side-walls with the first trough-like opening extending from an entrance side at which a marker plate is received to an exit side at which a received marker plate is ejected. The plurality of varying sized members are configured to be separately attached within the first trough-like opening of the chute, to extend from the entrance side to the exit side, to provide varying width second trough-like openings within the chute in order to accommodate varying width marker plates.

In an additional aspect of the disclosure, a hopper system for a marker plate embossing system is provided. The hopper system includes a hopper and a divider. The hopper comprises at least one side-wall attached to a bottom surface forming a cavity within the hopper. The divider is configured to be adjustably attached within the cavity of the hopper in varying positions relative to the at least one side-wall to accommodate varying width marker plates between the divider and the at least one side-wall.

BRIEF DESCRIPTION OF THE DRAWINGS

FIG. 2 illustrates a perspective view of the improved loading device of the system of FIG. 1.

FIG. 2B illustrates a perspective view of a stabilizing bar of the improved loading device of FIG. 2.

FIG. 2F illustrates a perspective view of a disassembled roller of the improved loading device of FIG. 2.

DETAILED DESCRIPTION OF THE DISCLOSURE

The following detailed description is of the best currently contemplated modes of carrying out the disclosure. The description is not to be taken in a limiting sense, but is made merely for the purpose of illustrating the general principles of the disclosure.

Figure 1:
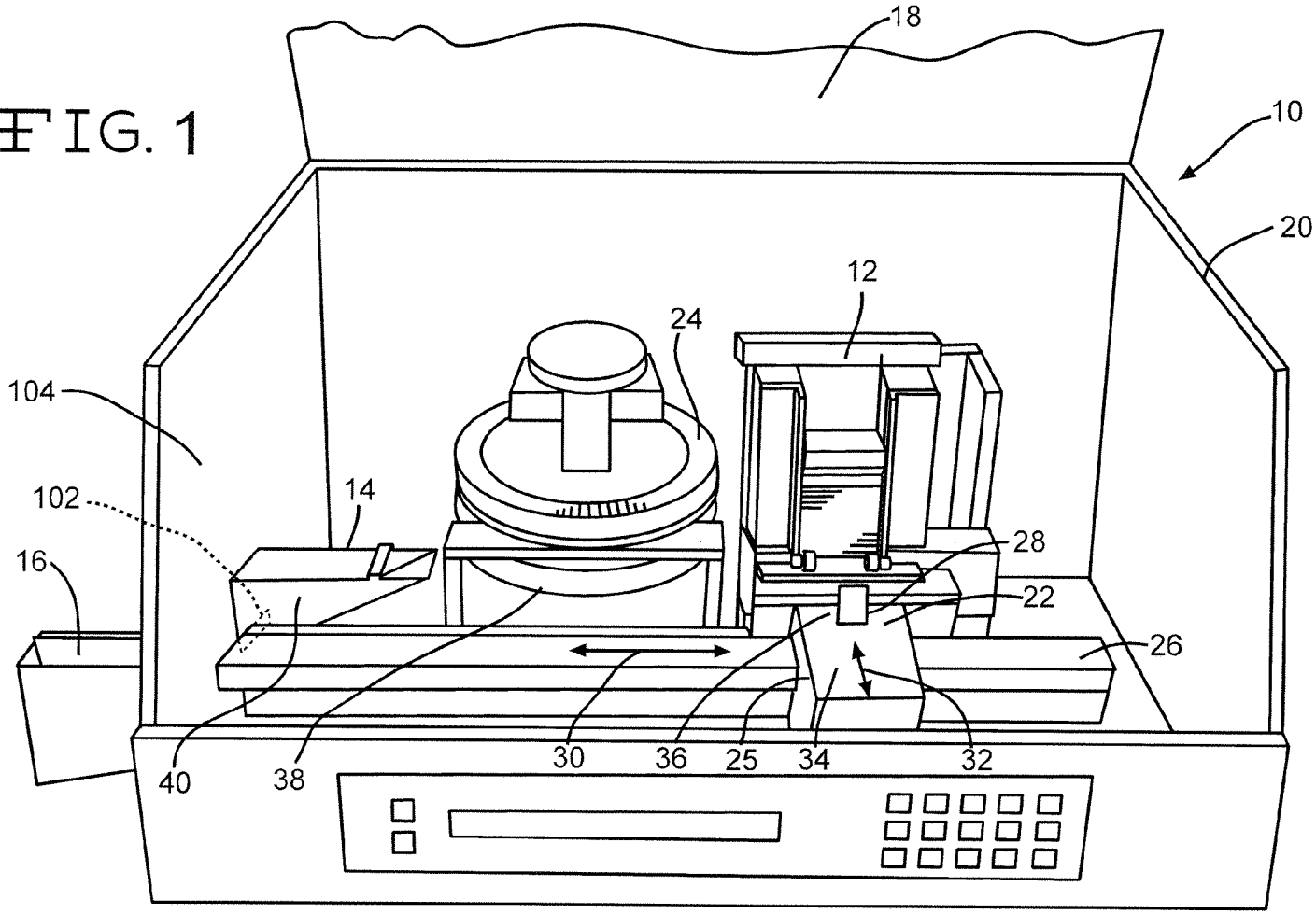
FIG. 1 illustrates a front view of a PANDUIT® PES197 portable embossing system with improvements made to the system's loading device, chute, and hopper.

FIG. 1 illustrates a front view of a PANDUIT® PES197 portable embossing system 10 with improvements made to the system's loading device 12, chute 14, and hopper 16. The system 10 is shown with the front cover-plate 18 removed from the housing 20 to allow the internal workings of the system 10 to be viewed. The system 10 may comprise a delivery device 22, the improved loading device 12, an embossing device 24, the improved chute 14, and the improved hopper 16.

The delivery device 22 may comprise a carriage 25 mounted on a track 26 extending between the loading device 12, the embossing device 24, and the chute 14. The carriage 25 may be secured to a gripping device 28. The gripping device 28 may comprise a clamp which is adapted to open and close. The carriage 25 may be adapted to move the gripping device 28 back and forth in direction 30 along the track 26, and back and forth along direction 32 transverse to the track 26. In such manner, the carriage 25 may be configured to move the gripping device 28 from a first location 34 disposed apart from the loading device 12, to a second location 36 disposed at the loading device 12, to a third location 38 disposed at the embossing device 24, and to a fourth location 40 disposed at the chute 14.

FIG. 2 illustrates a perspective view of the loading device 12. As shown in FIGS. 1 and 2, the loading device 12 may comprise opposed frame members 42 and 44 attached to respective gate members 43 and 45. FIG. 2A illustrates perspective views of the gate members 43 and 45. As shown in FIG. 2A, each gate member 43 and 45 may comprise surface 47 attached to surface 49 in an L-shape. Threaded holes 51 may be disposed in surface 47 of each gate member 43 and 45. Additional threaded holes 82 and 84 may be disposed in surfaces 49 near an end 55 of each gate member 43 and 45. End 57 of surface 47 of each gate member 43 and 45 may be disposed 0.2667 centimeters (0.105 inches) above end 55 of each gate member 43 and 45. In other embodiments, end 57 of surface 47 of each gate member 43 and 45 may be disposed in a range of 0.025 to 0.635 centimeters (0.010 to 0.25 inches) above end 55 of each gate member 43 and 45. As shown in FIGS. 2 and 2A, gate members 43 and 45 may be attached to respective frame members 42 and 44 with bolts 59 extending through holes 61 in the frame members 42 and 44 into the threaded holes 51 of the gate members 43 and 45. Holes 61 of the frame members 42 and 44 may be elongated allowing the vertical locations of the gate members 43 and 45 to be adjusted relative to the frame members 42 and 44 by adjusting the vertical heights of the bolts 59 in the holes 61 of the frame members 42 and 44. In such manner, by adjusting the vertical heights of the bolts 59 in the holes 61 of the frame members 42 and 44, the vertical distance between a base surface 90 of the loading device 12 and the end 55 of surface 47 of each gate member 43 and 45 may be adjusted.

The frame members 42 and 44 may be made of steel. In other embodiments, the frame members 42 and 44 may be made of varying rigid materials, such as metal, plastic, or a composite. The gate members 43 and 45 may be made of hardened steel. Preferably, the gate members 43 and 45 are made of material having a hardness range between Rockwell 25-35. This hardness range will prevent the end 55 of surface 47 of each gate member 43 and 45 from being damaged by the marker plates 56 as they pass between the ends 55 of surfaces 47 of the gate members 43 and 45 and base surface 90 of the loading device 12, as discussed later on in this disclosure. In other embodiments, the gate members 43 and 45 may be made of varying rigid materials, such as metal, plastic, or a composite.

A stabilizing bar 46 may be bolted to each of the frame members 42 and 44 using bolts 48 and 50. FIG. 2B illustrates a perspective view of the stabilizing bar 46. As shown in FIGS. 2 and 2B, the stabilizing bar 46 may comprise slots 52 and 54. The frame members 42 and 44 may be disposed in the slots 52 and 54 of the stabilizing bar 46, and the bolts 48 and 50 may be screwed against the frame members 42 and 44 securing the stabilizing bar 46 fixedly to the frame members 42 and 44. In other embodiments, the stabilizing bar 46 may be attached to each of the frame members 42 and 44 using other attachment mechanisms. The stabilizing bar 46 may be made of steel. In other embodiments, the stabilizing bar 46 may be made of varying rigid materials, such as metal, plastic, or a composite. The attachment of the stabilizing bar 46 between the frame members 42 and 44 stabilizes each of the frame members 42 and 44 and gate members 43 and 45 to prevent them from being bumped out of alignment relative to one another.

Figure 2A:
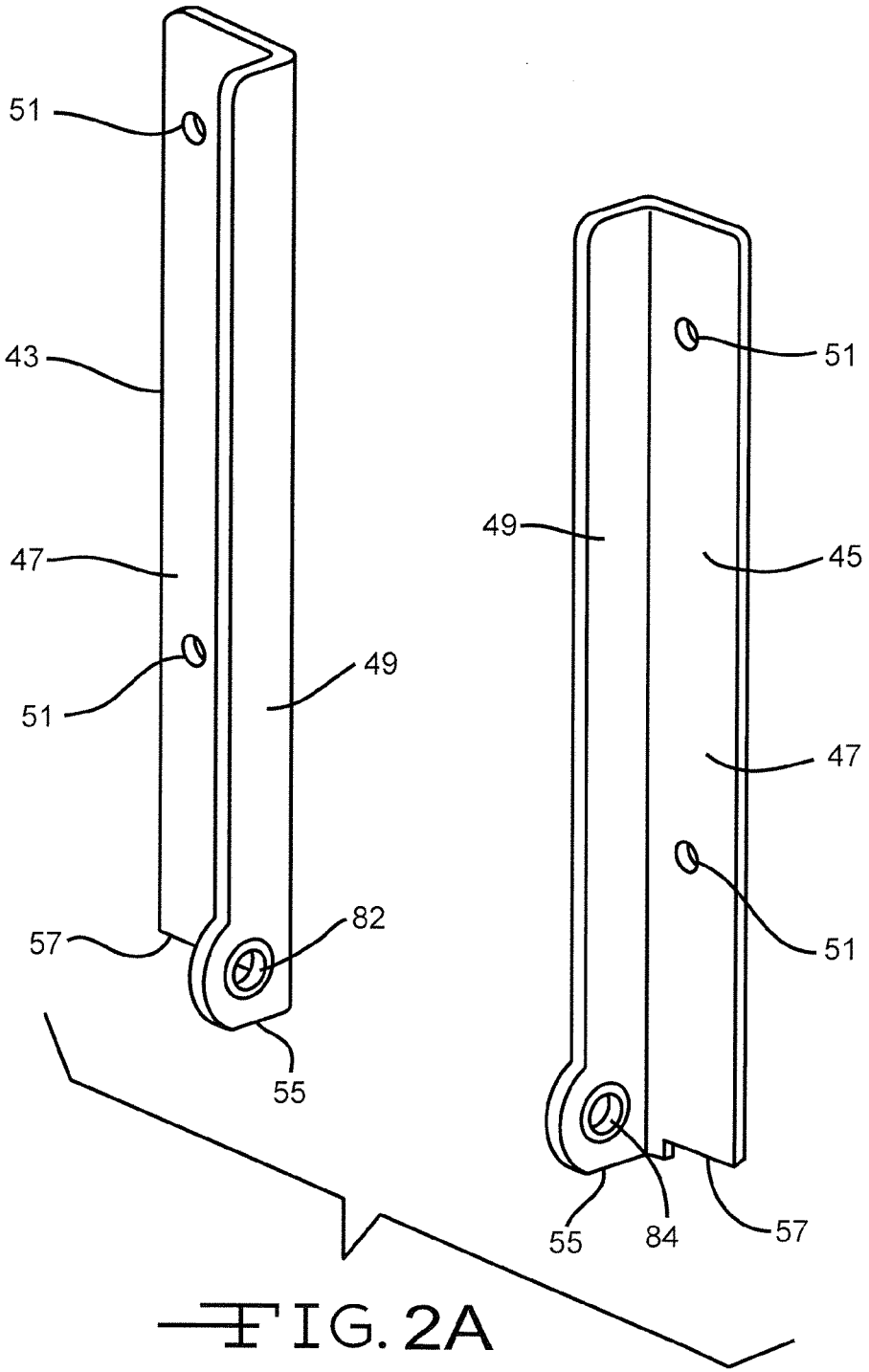
FIG. 2A illustrates perspective views of gate members of the improved loading device of FIG. 2.
Figure 2C:
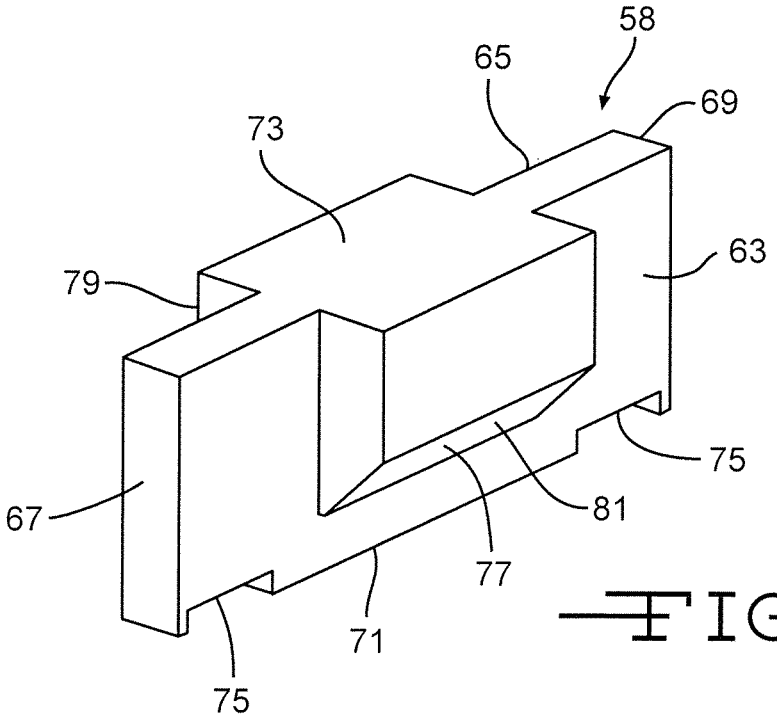
FIG. 2C illustrates a perspective view of a plate weight of the improved loading device of FIG. 2.

A plurality of marker plates 56 may be disposed in stacked alignment between the frame members 42 and 44. A plate weight 58 may be disposed on top of the stacked marker plates 56. The plate weight 58 may be made of steel. In other embodiments, the plate weight 58 may be made of varying heavy materials. FIG. 2C illustrates a perspective view of the plate weight 58. As shown in FIGS. 2 and 2C, the plate weight 58 may comprise parallel front and back surfaces 63 and 65, parallel side surfaces 67 and 69, and parallel bottom and top surfaces 71 and 73. The bottom surface 71 may have cut-outs 75 disposed in the bottom surface 71. The cut-outs 75 may be configured to accommodate raised end surfaces 75A of the marker plates 56 (as shown in FIG. 2). Tapered protrusions 77 and 79 may extend from the front and back surfaces 63 and 65. The tapered protrusions 77 and 79 may be identical. The tapered protrusions 77 and 79 may allow the plate weight 58 to be substantially increased in order to place more weight on the stack of marker plates 56 to decrease bowing of the marker plates 56. Different plate weights 58 may be used for different marker plates 56.

For a marker plate 56B having a width 72 of 0.95 centimeter (0.375 inches), due to the tapered protrusions 77 and 79, a plate weight 58 weighing 294 grams (0.65 pounds) may be used. This may comprise a 82 percent increase in weight over the prior plate weights used without the tapered protrusions 77 and 79. For a marker plate 56B having a width 72 of 1.37 centimeters (0.54 inches), due to the tapered protrusions 77 and 79, a plate weight 58 weighing 388 grams (0.85 pounds) may be used. For a marker plate 56B having a width 72 of 1.905 centimeters (0.750 inches), due to the tapered protrusions 77 and 79, a plate weight 58 weighing 506 grams (1.1 pounds) may be used. This may comprise a 33 percent increase in weight over the prior plate weights used without the tapered protrusions 77 and 79. The tapered protrusions 77 and 79 may allow for plate weights 58 having their weight increased in a range of 30 to 90 percent over that of the prior plate weights used. Due to the taper 81 of the tapered protrusion 77, a marker plate sensor 53 in the base member 90 will not be triggered inadvertently because the taper 81 will not be detected. As a result, when the increased plate weight 58 is in place, the marker plate sensor 53 in the base member 90 will properly detect whether a marker plate 56B is disposed over the base member 90.

Knobs 60 and 62 may be rotated to move width adjustment bars 64 and 66 located within the frame members 42 and 44 back and forth in directions 68 and 70 to move the width adjustment bars 64 and 66 relative to the frame members 42 and 44 and the gate members 43 and 45. In such manner, by adjusting the knobs 60 and 62, the width adjustment bars 64 and 66 may be abutted against marker plates 56 having varying widths 72 in order to accommodate varying sized marker plates 56. This may stabilize the stacked marker plates 56 within the frame members 42 and 44.

Figure 2D:
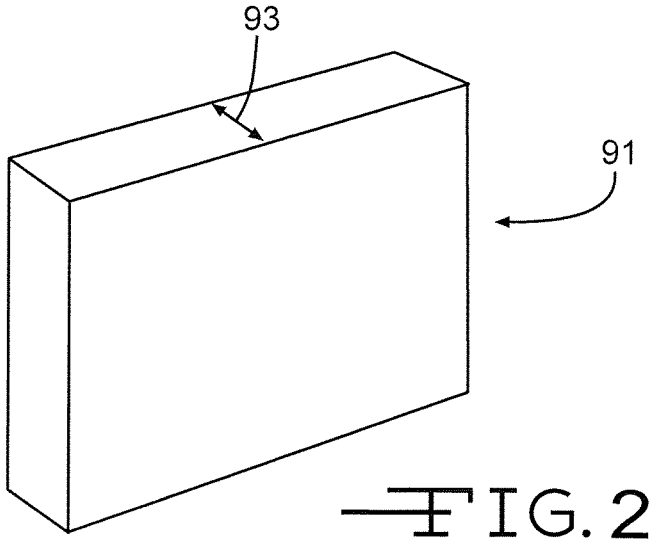
FIG. 2D illustrates a perspective view of a sizing block that may be used to align width adjustment bars of the improved loading device of FIG. 2 into proper position.

FIG. 2D illustrates a perspective view of a sizing block 91 that may be used to align the width adjustment bars 64 and 66 into proper position relative to the gate members 43 and 45 prior to inserting the stack of marker plates 56. The sizing block 91 may comprise a rectangular member made of aluminum. In other embodiments, the sizing block 91 may be made of any rigid material. The sizing block 91 may have a width 93 selected to be the appropriate size for whatever width marker plates 56 are to be inserted into the loading device 12. The sizing block 91 may have a width 93 of 1.029 centimeters (0.405 inches) for marker plates 56 having a width 72 of 0.95 centimeters (0.375 inches). In another embodiment, for marker plates 56 having a width 72 of 0.95 centimeters (0.375 inches), the sizing block 91 may have a width 93 ranging between 1.00 centimeters to 1.05 centimeters (0.395 inches to 0.415 inches). The sizing block 91 may have a width 93 of 1.45 centimeters (0.570 inches) for marker plates 56 having a width 72 of 1.37 centimeters (0.540 inches). In another embodiment, for marker plates 56 having a width 72 of 1.37 centimeters (0.540 inches), the sizing block 91 may have a width 93 ranging between 1.42 centimeters to 1.47 centimeters (0.560 inches to 0.580 inches). The sizing block 91 may have a width 93 of 1.98 centimeters (0.780 inches) for marker plates 56 having a width 72 of 1.905 centimeters (0.750 inches). In another embodiment, for marker plates 56 having a width 72 of 1.905 centimeters (0.750 inches), the sizing block 91 may have a width 93 ranging between 1.96 centimeters to 2.01 centimeters (0.770 inches to 0.790 inches). Preferably, the sizing block 91 has a width 93 ranging between 2 to 10 percent larger than the width 72 of the marker plates 56 to be inserted into the loading device 12.

Figure 2E:
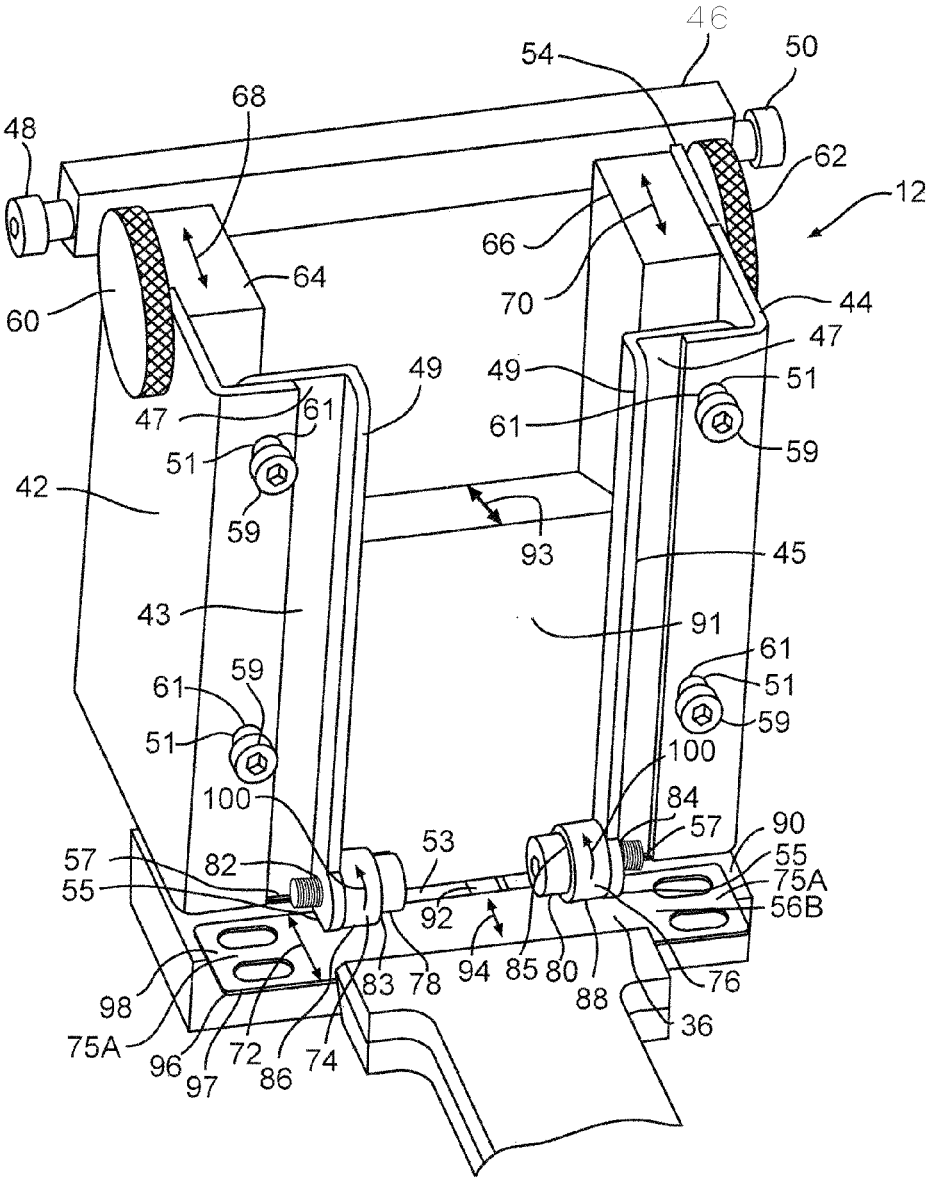
FIG. 2E illustrates a perspective view of the sizing block of FIG. 2D inserted into the improved loading device of FIG. 2 in place of a stack of marker plates and a plate weight.

FIG. 2E illustrates a perspective view of the sizing block 91 of FIG. 2D inserted into the improved loading device 12 of FIG. 2 in place of the stack of marker plates 56 and the plate weight 58. Prior to inserting the stack of marker plates 56 and the plate weight 58 into the loading device 12, the knobs 60 and 62 may be rotated to move the width adjustment bars 64 and 66 away from the gate members 43 and 45. The appropriate width 93 sizing block 91, sized for the width 72 of the marker plates 56 to be later inserted into the loading device 12, may then be inserted into the loading device 12. Next, the knobs 60 and 62 may be rotated to move the width adjustment bars 64 and 66 against the sizing block 91 to align the width adjustment bars 64 and 66 into the proper position relative to the gate members 43 and 45 prior to inserting the stack of marker plates 56. Then, the sizing block 91 may be removed from the loading device 12, the stack of marker plates 56 may be inserted into the loading device 12, and the plate weight 58 may be inserted into the loading device 12 on top of the stack of marker plates 56 as shown in FIG. 2. Use of the sizing block 91 may allow the stack of marker plates 56 to be placed between the width adjustment bars 64 and 66 and the gate members 43 and 45 with the appropriate amount of force being applied by the width adjustment bars 64 and 66 against the marker plates 56. In such manner, the likelihood of the marker plates 56 becoming jammed within the loading device 12 is substantially reduced.

Rollers 74 and 76 may be attached to each of the gate members 43 and 45 in spaced-apart relation. FIG. 2F illustrates a perspective view of one of the disassembled rollers 76. As shown in FIGS. 2 and 2F, the rollers 74 and 76 may be attached to the gate members 43 and 45 with steel shoulder bolts 78 and 80 extending through threaded holes 82 and 84 in the gate members 43 and 45. The rollers 74 and 76 may have bronze bearings 83 and 85 pressed into the rollers 74 and 76. The rollers 74 and 76 may have rubber surfaces to prevent marring or scratching of the marker plates 56. In other embodiments, the bearings 83 and 85, and shoulder bolts 78 and 80 may be made of varying rigid materials, such as metal, a composite, or plastic. In still other embodiments, the rollers 74 and 76 may be made of varying flexible materials, such as foam, polymers, or felt (fiber). Bottom surfaces 86 and 88 of the rollers 74 and 76 may be disposed 0.04 centimeters (0.016 inches) below the end 55 of each of the gate members 43 and 45. In other embodiments, the bottom surfaces 86 and 88 of the rollers 74 and 76 may be disposed in a range of 0.012 centimeters (0.005 inches) to 0.04 centimeters (0.016 inches) below the end 55 of each of the gate members 43 and 45.

When harder materials are used for the rollers 74 and 76, the bottom surfaces 86 and 88 of the rollers 74 and 76 may be placed a distance above the base-surface 90 due to the lack of compressibility of the rollers 74 and 76. When softer materials are used for the rollers 74 and 76, the bottom surface 86 and 88 of the rollers 74 and 76 may be placed a distance below the base-surface 90 due to the compressibility of the rollers 74 and 76. The bottom surfaces 86 and 88 of the rollers 74 and 76 may be disposed so that the distance between the base-surface 90 and the bottom surfaces 86 and 88 of the rollers 74 and 76 is less than the thickness 97 of each of the marker plates 56. Preferably, the distance between the base-surface 90 and the bottom surfaces 86 and 88 of the rollers 74 and 76 is 10 percent of the thickness 97 of each of the marker plates 56. In another embodiment, the distance between the base-surface 90 and the bottom surfaces 86 and 88 of the rollers 74 and 76 may be in a range of 5 to 15 percent of the thickness 97 of each of the marker plates 56. In one embodiment, the distance between the base-surface 90 and the bottom surfaces 86 and 88 of the rollers 74 and 76 may comprise 0 centimeters (0 inches). In other embodiments, the bottom surfaces 86 and 88 of the rollers 74 and 76 may be disposed in a range of 0.25 centimeters (0.01 inches) below the base-surface 90 to 0.25 centimeters (0.01 inches) above the base-surface 90. In additional embodiments, the bottom surfaces 86 and 88 of the rollers 74 and 76 may be disposed above the base-surface 90 in a range of 10 to 30 percent of the thickness 97 of the marker plates 56. In still other embodiments, the bottom surfaces 86 and 88 of the rollers 74 and 76 may be disposed above the base-surface 90 in a range of 10 to 60 percent of the thickness 97 of the marker plates 56. In additional embodiments, the bottom surfaces 86 and 88 of the rollers 74 and 76 may be disposed in a range of 160 percent of the thickness 97 of the marker plates 56 above the base-surface 90 to 60 percent of the thickness 97 of the marker plates 56 below the base-surface 90. In still other embodiments, the bottom surfaces 86 and 88 of the rollers 74 and 76 may be disposed at varying distances above or below the base-surface 90 to accommodate varying thickness 97 marker plates 56.

The rollers 74 and 76 may be adapted to freely rotate. A marker plate moving member 92 may be disposed between the frame members 42 and 44 behind a bottom marker plate 56B of the stack 56. The marker plate moving member 92 may be adapted to move back and forth in direction 94 in order to push the bottom marker plate 56B out of the stack 56 between the end 57 of the surface 47 of each gate member 43 and 45 and the base-surface 90. As the marker plate moving member 92 moves the bottom marker plate 56B out of the stack 56, a bottom surface 96 of the bottom marker plate 56B will abut against the base-surface 90, and a top surface 98 of the bottom marker plate 56B will abut against the bottom surfaces 86 and 88 of the rollers 74 and 76. The movement of the marker plate moving member 92 forward in direction 94 will cause the rollers 74 and 76 to rotate in direction 100 loading the bottom marker plate 56B and its bottom surface 96 against base-surface 90 in the second location 36 disposed on the base-surface 90. Due to end 55 of surface 47 of each gate member 43 and 45 being disposed 0.040 centimeters (0.016 inches) above the base-surface 90, or in other embodiments being disposed the appropriate distance to accommodate the thickness 97 of only one marker plate 56B, only one marker plate 56B at a time will be able to fit between the end 55 of surface 47 of each gate member 43 and 45 and the base-surface 90. As a result, the arrangement of end 55 of surface 47 of each gate member 43 and 45 relative to the base-surface 90 may help prevent a misfeed of multiple marker plates 56 coming out of the loading device 12 at a time. The rubber surfaces of the rollers 74 and 76 are designed to compress against the marker plate 56B to keep the marker plate 56B flat against the base-surface 90. This helps prevent bowing of the marker plate 56B, and also helps prevent a misfeed or jam-up of the marker plate 56B between the gate members 43 and 45. Moreover, the use of the stabilizing bar 46 helps to prevent the frame members 42 and 44 and the gate members 43 and 45 from being bumped out of alignment due to vibration of the loading device 12, or from loading marker plates 56 into the loading device 12.

As shown in FIGS. 1 and 2, when a marker plate 56B is moved from the stack 56 to the second location 36 disposed on the base-surface 90, the carriage 25 may move the gripping device 28 from the first location 34 disposed apart from the loading device 12 to the second location 36 disposed at the loading device 12. The gripping device 28 may then grip the marker plate 56B disposed on the base-surface 90. The carriage 25 may then move the gripping device 28 holding the marker plate 56B to the third location 38 disposed at the embossing device 24. The embossing device 24 may emboss the marker plate 56B with a symbol, a letter, a number, or with another embossed marking. The carriage 25 may then move the gripping device 28 holding the embossed marker plate 56B to the fourth location 40 disposed at the chute 14. The gripping device 28 may release the embossed marker plate 56B so that it falls into the chute 14. The chute 14 may be angled, as provided in the following paragraph, to cause the embossed marker plate 56B to slide down the chute 14, through an opening 102 in the side-wall 104 of the housing 20, and into the hopper 16. The carriage 25 may then move back to the second location 36 disposed at the loading device 12. The gripping device 28 may then grip another marker plate 56B which was moved onto the base-surface 90 from the stack of marker plates 56 using the end 55 of surface 47 of each gate member 43 and 45 and rollers 74 and 76. The entire process may then be repeated to sequentially emboss the marker plates 56 of the stack and deliver them, in the identical stacked arrangement, into the hopper 16.

Figures 3, 3A:
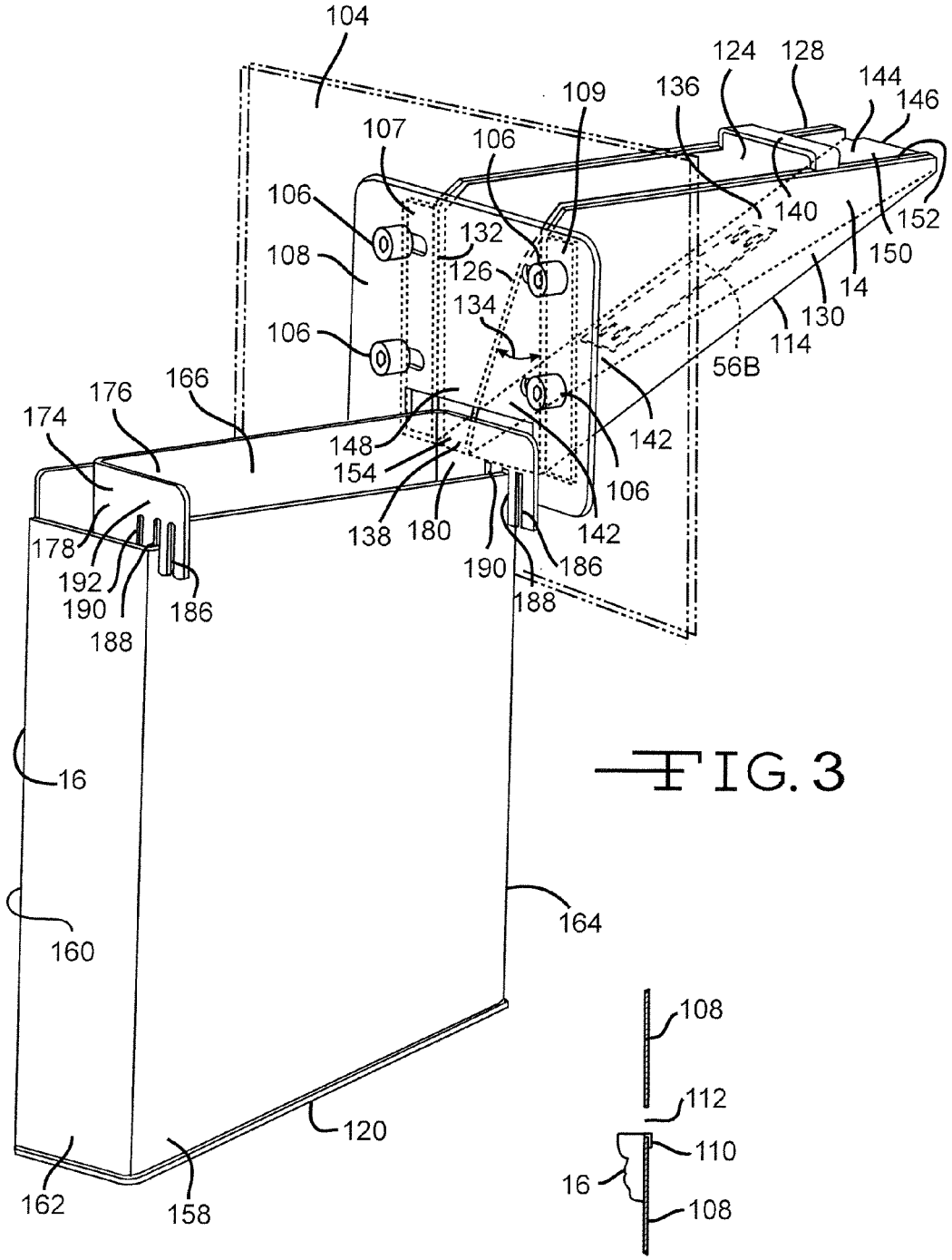
FIG. 3 illustrates a perspective view of the improved chute and hopper of the system of FIG. 1.
FIG. 3A illustrates a side view showing the connection of the hopper of FIG. 3 to a plate of the system of FIG. 1.
Figure 4:
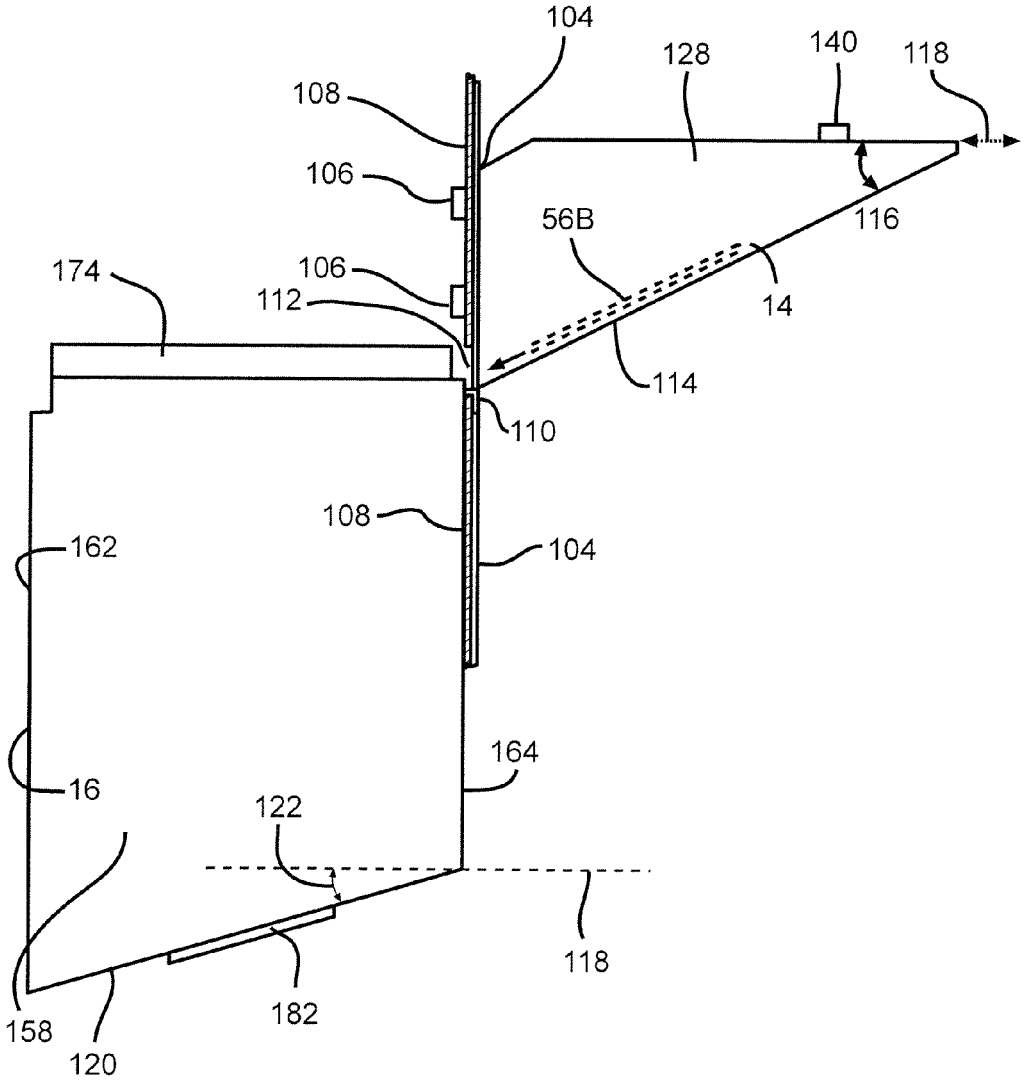
FIG. 4 illustrates a side view of the chute and hopper of FIG. 3.

FIGS. 3 and 4 illustrate, respectively, perspective and side views of the steel chute 14 and steel hopper 16 attached to the side-wall 104 of the housing 20 (shown in FIG. 1). A large portion of the side-wall 104 has been cut-away for illustrative purposes. As shown in FIGS. 3 and 4, the chute 14 may be attached to the side-wall 104 of the housing 20 with steel bolts 106 extending through flanges 107 and 109 of the chute 14. FIG. 3A illustrates a side view showing the connection of the hopper 16 to a steel plate 108 (also shown in FIGS. 3 and 4) of the housing 20 (shown in FIG. 1). The hopper 16 may be attached to the plate 108 with a steel hook 110 attached through an opening 112 in the plate 108. In other embodiments, the chute 14, hopper 16, bolts 106, plate 108, and hook 110 may be made of varying rigid materials, such as metal, a composite, or plastic. A bottom surface 114 of the chute 14 may be angled downward at an angle 116 of 15 degrees from the horizontal plane 118 to cause the marker plate 56B to slide down the chute 14. In other embodiments, the bottom surface 114 of the chute 14 may be angled downward at an angle 116 in a range of 10 to 20 degrees from the horizontal plane 118. The bottom surface 120 of the hopper 16 may be angled downward at an angle 122 of fifteen degrees from the horizontal plane 118. In other embodiments, the bottom surface 120 of the hopper 16 may be angled downward at an angle 122 in a range of 10 to 30 degrees from the horizontal plane 118. Angle 122 helps prevent the marker plate 56B from bouncing within the hopper 16 as the marker plate 56B hits the bottom surface 120 of the hopper 16. Moreover, angle 122 allows more marker plates 56 to be stacked within the hopper 16.

Figure 5:
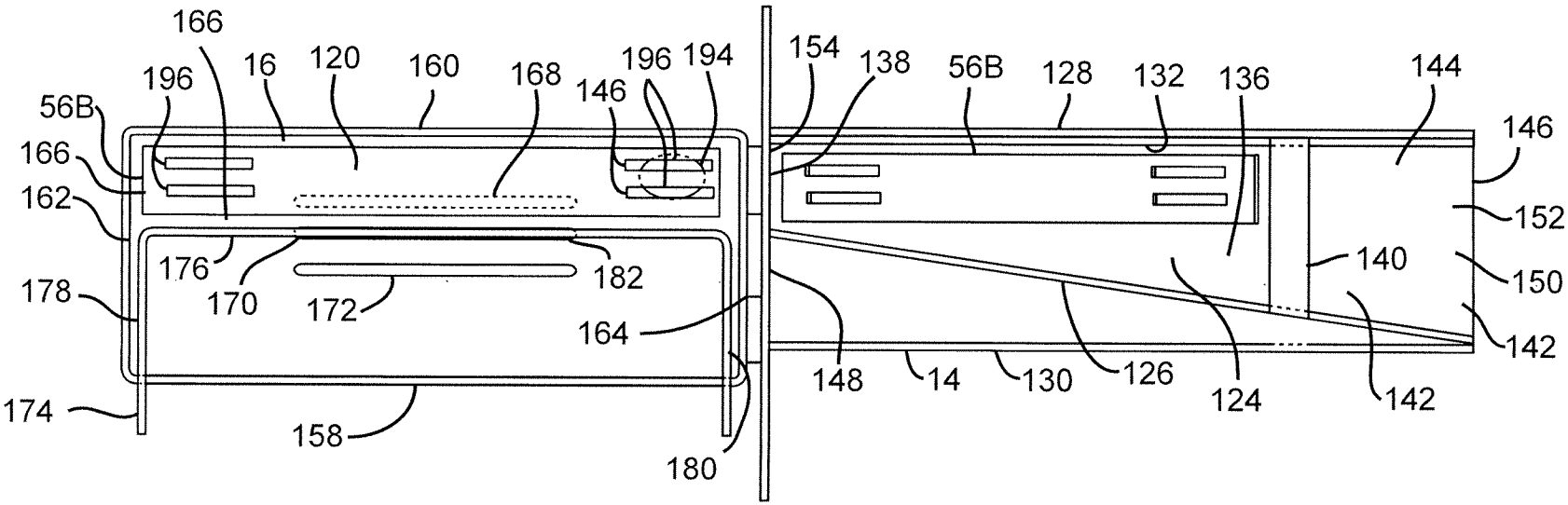
FIG. 5 illustrates a top view of the chute and hopper of FIG. 3.

FIG. 5 illustrates a top view of the chute 14 and hopper 16 of FIGS. 3 and 4. As shown in FIGS. 3 and 5, a steel chute insert 124 may be disposed within the chute 14. In other embodiments, the chute insert 124 may be made of varying rigid materials, such as metal, a composite, or plastic. The chute insert 124 may have one side-wall 132 which is parallel to the side-walls 128 and 130 of the chute 14, and another side-wall 126 which is angled relative to the side-walls 128 and 130 of the chute 14. In one embodiment, the side-wall 126 of the chute insert 124 may be angled at an angle 134 of 5 degrees relative to the side-wall 130 of the chute 14. The side-walls 128 and 130 of the chute 14 may be aligned straight up and down in vertical planes. In other embodiments, the side-wall 126 of the chute insert 124 may be angled at an angle 134 in a range of 5 to 10 degrees relative to the side-wall 130 of the chute 14. The angle 134 of the side-wall 126 of the chute insert 124 may provide for a larger entrance area 136 for the marker plate 56B and a smaller exit area 138 for the marker plate 56B. This may make it easier for the chute insert 124 to catch the marker plate 56B as it falls into the entrance area 136 of the chute insert 124, but at the same time, force the marker plate 56B to be directed into a smaller exit area 138 so that the marker plate 56B exits the chute insert 124 in the desired orientation. An anti-rotation bar 140 may be attached between the side-walls 126 and 132 of the chute insert 124. The anti-rotation bar 140 will lessen the likelihood that the marker plate 56B will flip over as it falls into the chute insert 124 within the chute 14. If the marker plate 56B bounces up after striking a bottom surface 142 of the chute insert 124, the marker plate 56B may hit the anti-rotation bar 140 preventing the marker plate 56B from flipping over. This is important as the marker plates 56 need to be delivered to the hopper 16 in the same configuration as they were stacked within the loading device 12.

Figure 6:
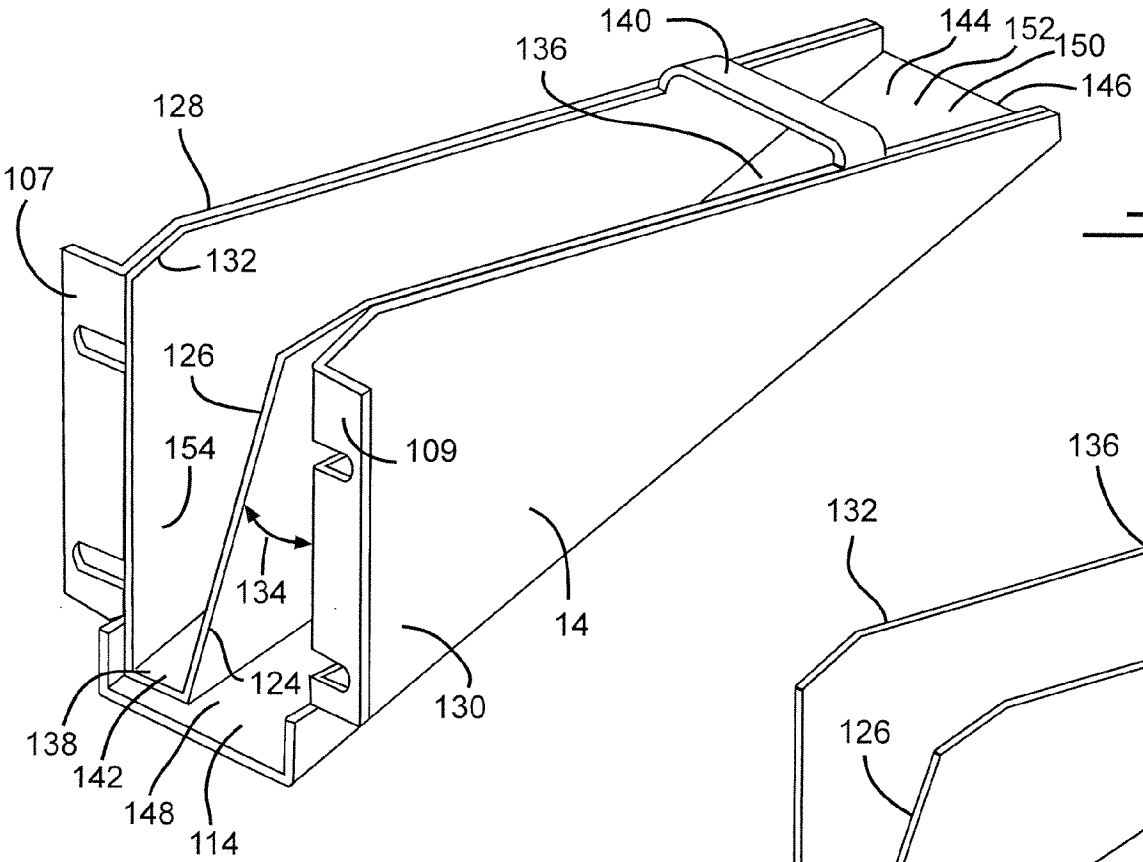
FIG. 6 illustrates a perspective view of the chute of FIG. 3 showing a chute insert disposed within the chute.
Figure 7:
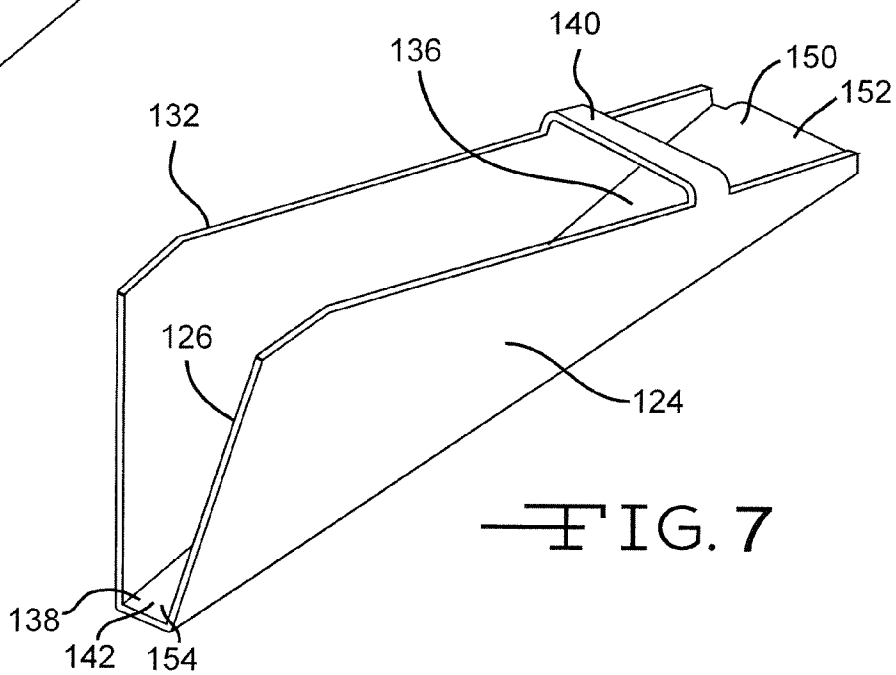
FIG. 7 illustrates a perspective view of the chute insert of FIG. 6 removed from the chute.

FIG. 6 illustrates a perspective view of the chute 14 with the chute insert 124 disposed within the chute 14. FIG. 7 illustrates a perspective view of the chute insert 124 removed from the chute 14. As shown in FIGS. 4-6, the side-walls 128 and 130 of the chute 14 may be parallel in vertical planes, and the bottom surface 114 of the chute 14 may be attached perpendicularly between the parallel side-walls 128 and 130. A trough-like opening 144 may extend between the parallel side-walls 128 and 130 from one side 146 of the chute 14 to another side 148 of the chute 14. The chute 14 may have a U-shape. In other embodiments, the shape of the chute 14 may vary.

As shown in FIGS. 4-7, the chute insert 124 may comprise the bottom surface 142 attached between the side-walls 126 and 132. The bottom surface 142 of the chute insert 124 may be disposed parallel to the bottom surface 114 of the chute 14, and perpendicular to side-wall 132 of the chute insert 124. Side-wall 126 of the chute insert 124 may be angled relative to side-walls 128 and 130 of the chute 14, which may be disposed in vertical planes. Side-wall 132 of the chute insert 124 may be disposed parallel to side-walls 128 and 130 of the chute 14. Another trough-like opening 150 may extend between the side-walls 126 and 132 from one side 152 of the chute insert 124 to another side 154 of the chute insert 124. Varying sized chute inserts 124, having tailored distances between the side-walls 126 and 132 of the chute inserts 124, may be used to accommodate varying width 72 marker plates 56 (as shown in FIG. 2). For instance, one-size chute insert 124 may be used for marker plates 56 having a width 72 of 1.905 centimeters (0.75 inches), a smaller chute insert 124 may be used for marker plates 56 having a width 72 of 1.3 centimeters (0.5 inches), and an even smaller chute insert 124 may be used for marker plates 56 having a width 72 of 0.95 centimeter (0.375 inches). Preferably, for each of these varying sized chute inserts 124, the distance between the side-walls 126 and 132 of the chute insert 124 at the entrance side 152 of the chute insert 124 is greater than the distance between the side-walls 126 and 132 of the chute insert 124 at the exit side 154 of the chute insert 124. Preferably, the distance between the side-walls 126 and 132 of the chute insert 124 at the entrance side 152 of the chute insert 124 is 100 percent larger than the width 72 of the marker plates 56. In other embodiments, the distance between the side-walls 126 and 132 of the chute insert 124 at the entrance side 152 of the chute insert 124 may be in a range of 50 to 300 percent larger than the width 72 of the marker plates 56. Preferably, the distance between the side-walls 126 and 132 of the chute insert 124 at the exit side 154 of the chute insert 124 is 6 percent larger than the width 72 of the marker plates 56. In other embodiments, the distance between the side-walls 126 and 132 of the chute insert 124 at the exit side 154 of the chute insert 124 may be in a range of 6 to 13 percent larger than the width 72 of the marker plates 56. In still other embodiments, varying sized chute inserts 124 in differing locations and orientations may be used to accommodate varying sized marker plates 56. In additional embodiments, both of the side-walls 126 and 132 of the chute insert 124 may be angled to be non-parallel relative to the side-walls 128 and 130 of the chute 14.

As shown in FIGS. 3-5, the hopper 16 may comprise the angled bottom surface 120 attached to two separate sets of opposed parallel side-walls 158 and 160, and 162 and 164. Side-walls 158 and 160 may be perpendicular to side-walls 162 and 164. All of the side-walls 158, 160, 162, and 164 may be disposed in vertical planes. A cavity 166 may be disposed between the two sets of side-walls 158 and 160, and 162 and 164. Three slots 168, 170, and 172 may be disposed in the angled bottom surface 120. In other embodiments, a varying number of slots 168, 170, and 172 may be disposed in the bottom surface 120. The slots 168, 170, and 172 may be parallel to side-walls 158 and 160 and perpendicular to side-walls 162 and 164.

Figure 8:
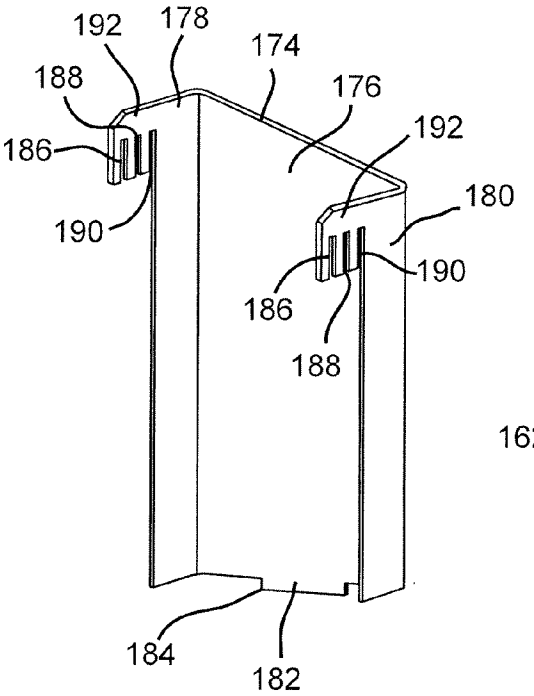
FIG. 8 illustrates a perspective view of a divider of FIG. 3 removed from the hopper.

A perspective view of a steel divider 174 is shown in FIG. 8. In other embodiments, the divider 174 may be made of varying rigid materials, such as metal, a composite, or plastic. The divider 174 may comprise a U-shape having a middle surface 176 attached to two side-surfaces 178 and 180. The middle surface 176 may be perpendicular to the side-surfaces 178 and 180. A tab 182 may be disposed at an end 184 of the middle surface 176. Three slots 186, 188, and 190 may be disposed near one end 192 of each side-surface 178 and 180. In other embodiments, a varying number of slots 186, 188, and 190 may be disposed in each side-surface 178 and 180.

As shown in FIGS. 3 and 5, the divider 174 may be inserted into the hopper 16 into three varying positions by inserting the tab 182 of the divider 174 into a different one of the slots 168, 170, and 172 of the angled bottom surface 120, and by simultaneously inserting the side-wall 158 of the hopper 16 into a different one of the slots 186, 188, and 190 at the end 192 of each side-surface 178 and 180 of the divider 174. By varying which slots 168, 170, 172, 186, 188, and 190 are used, the position of the divider 174 may be changed within the hopper 16 to accommodate varying width 72 marker plates 56. The marker plates 56 may stack up on the bottom surface 120 of the hopper 16 between side-wall 160 of the hopper 16 and the middle surface 176 of the divider 174. When the tab 182 is disposed in slot 168, the distance between the side-wall 160 of the hopper 16 and the middle surface 176 of the divider 174 may accommodate a marker plate 56 having a width 72 of 0.95 centimeters (0.375 inches). When the tab 182 is disposed in slot 170, the distance between the side-wall 160 of the hopper 16 and the middle surface 176 of the divider 174 may accommodate a marker plate 56 having a width 72 of 1.37 centimeters (0.54 inches). When the tab 182 is disposed in slot 172, the distance between the side-wall 160 of the hopper 16 and the middle surface 176 of the divider 174 may accommodate a marker plate 56 having a width 72 of 1.905 centimeters (0.75 inches). In other embodiments, a varying number of slots 168, 170, and 172 in differing sizes, locations, and orientations may be used to accommodate marker plates 56 having additional width 72 variations.

Figure 9:
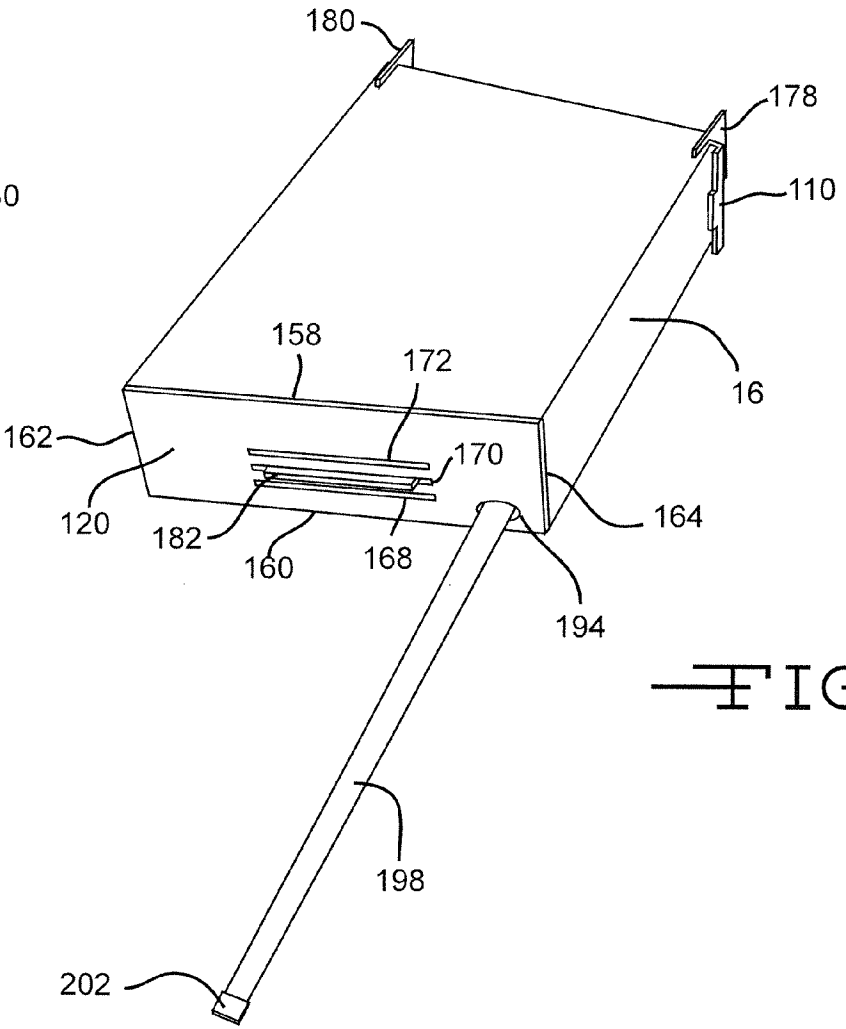
FIG. 9 illustrates a perspective view of the hopper of FIG. 3 with a tie-rod being inserted into a hole in a bottom of the hopper.
Figure 10:
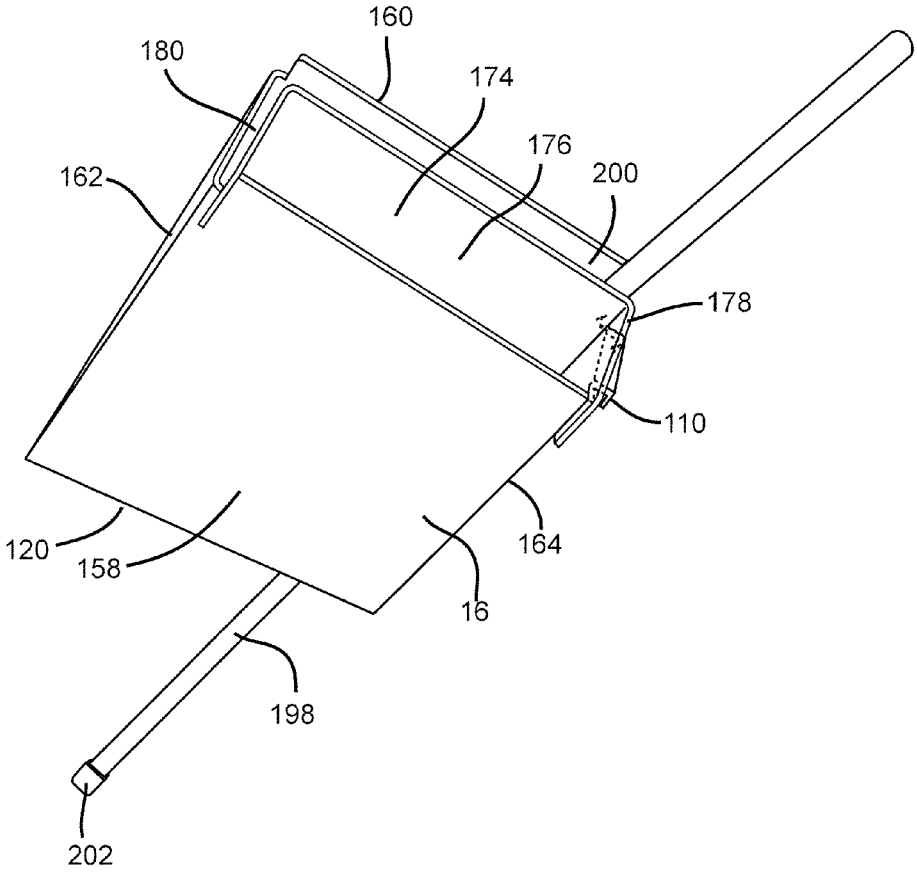
FIG. 10 illustrates a perspective view of the hopper of FIG. 9 with the tie-rod being pulled through a top of the hopper.
Figure 11:
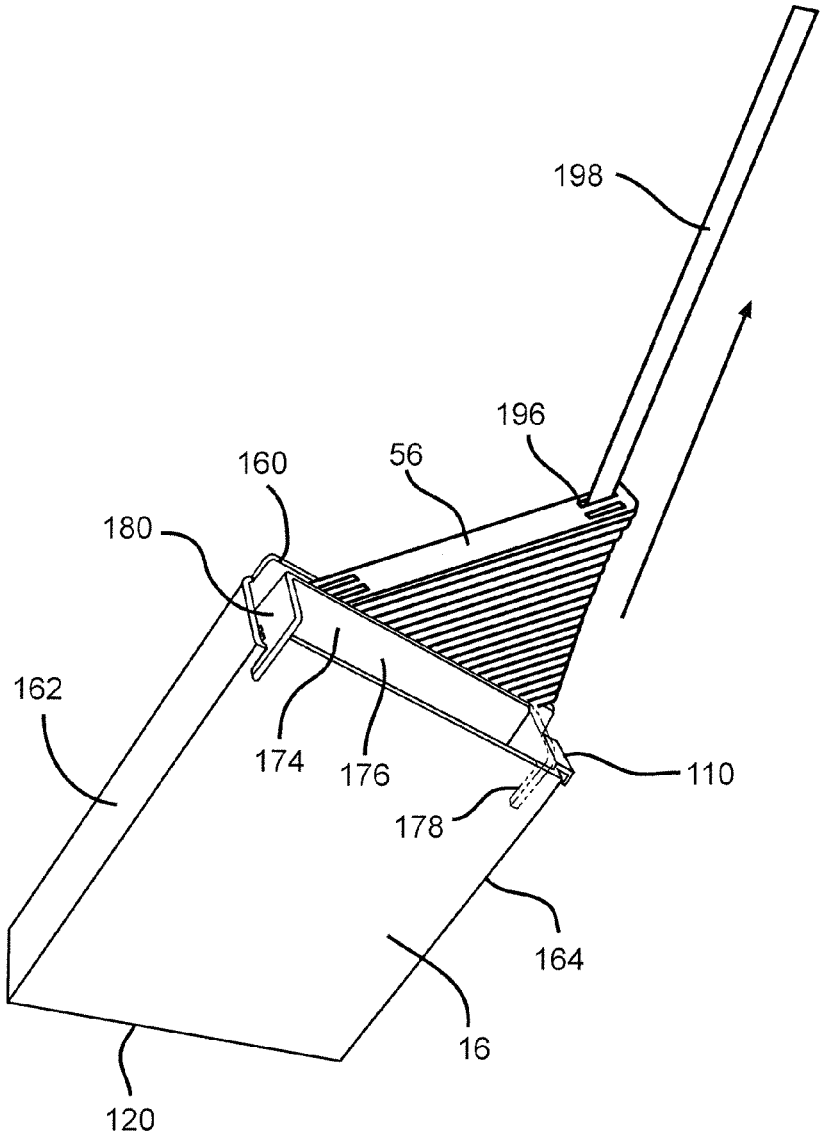
FIG. 11 illustrates a perspective view of the hopper of FIG. 10 with the tie-rod being pulled out of the hopper pulling stacked marker plates with the tie-rod.

As shown in FIG. 5, the bottom surface 120 of the hopper 16 may contain a hole 194. The hole 194 may be located between the side-wall 160 of the hopper 16 and the slot 168 of the bottom surface 120 of the hopper 16. The hole 194 may be aligned with stacked holes 196 in stacked marker plates 56 held between the side-wall 160 of the hopper 16 and the middle surface 176 of the divider 174. After the marker plates 56 stack up between the side-wall 160 of the hopper 16 and the middle surface 176 of the divider 174, as illustrated in FIG. 9, the hook 110 of the hopper 16 may be unhooked from the plate 108 (shown in FIG. 3A) attached to the housing 20 (shown in FIG. 1) and a plastic, stainless steel, or steel tie-rod 198 may be inserted into the hole 194 from the bottom surface 120 of the hopper 16 to force the tie-rod 198 through the stacked holes 196 in the stacked marker plates 56 held within the hopper 16. In other embodiments, the tie-rod 198 may be made of varying rigid materials, such as metal, a composite, or plastic. As shown in FIG. 10, the tie-rod 198 may be pulled through the top 200 of the hopper 16 between the side-wall 160 of the hopper 16 and the middle surface 176 of the divider 174. As shown in FIG. 11, the tie-rod 198 may be pulled out of the hopper 16 to pull the stacked marker plates 56 out of the hopper 16 in the same stacked order they were disposed within the hopper 16. This occurs because the end 202 (shown in FIGS. 9 and 10) of the tie-rod 198 has a greater size than the stacked holes 196 of the stacked marker plates 56. As a result, the end 202 of the tie-rod 198 abuts against the bottom marker plate 56B forcing the stacked marker plates 56 to come out of the hopper 16, in the same order as they were stacked within the hopper 16, as the tie-rod 198 is pulled out of the hopper 16.

Figure 12:
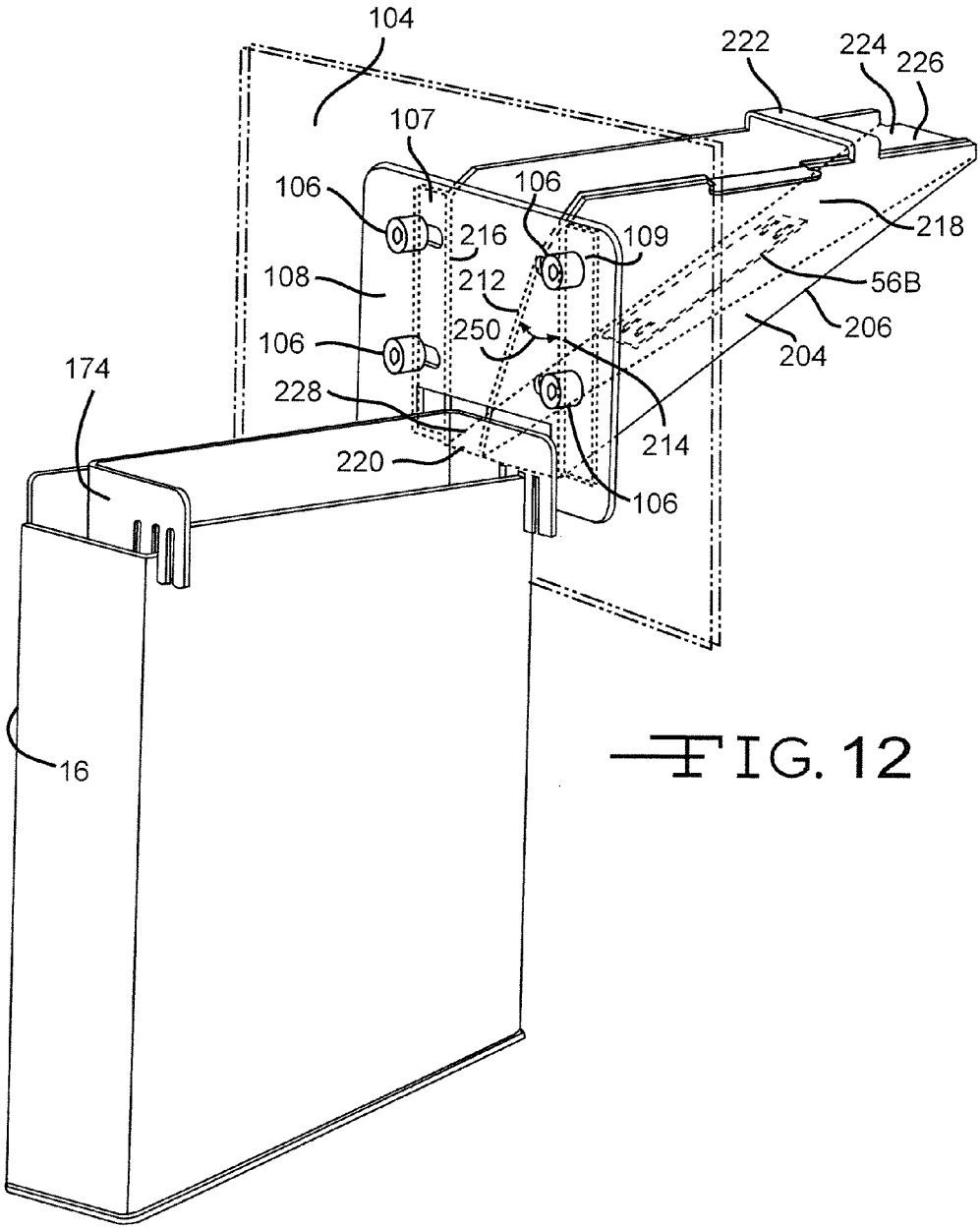
FIG. 12 illustrates a perspective view of the hopper of FIG. 3 attached to another embodiment of an improved chute.
Figure 13:
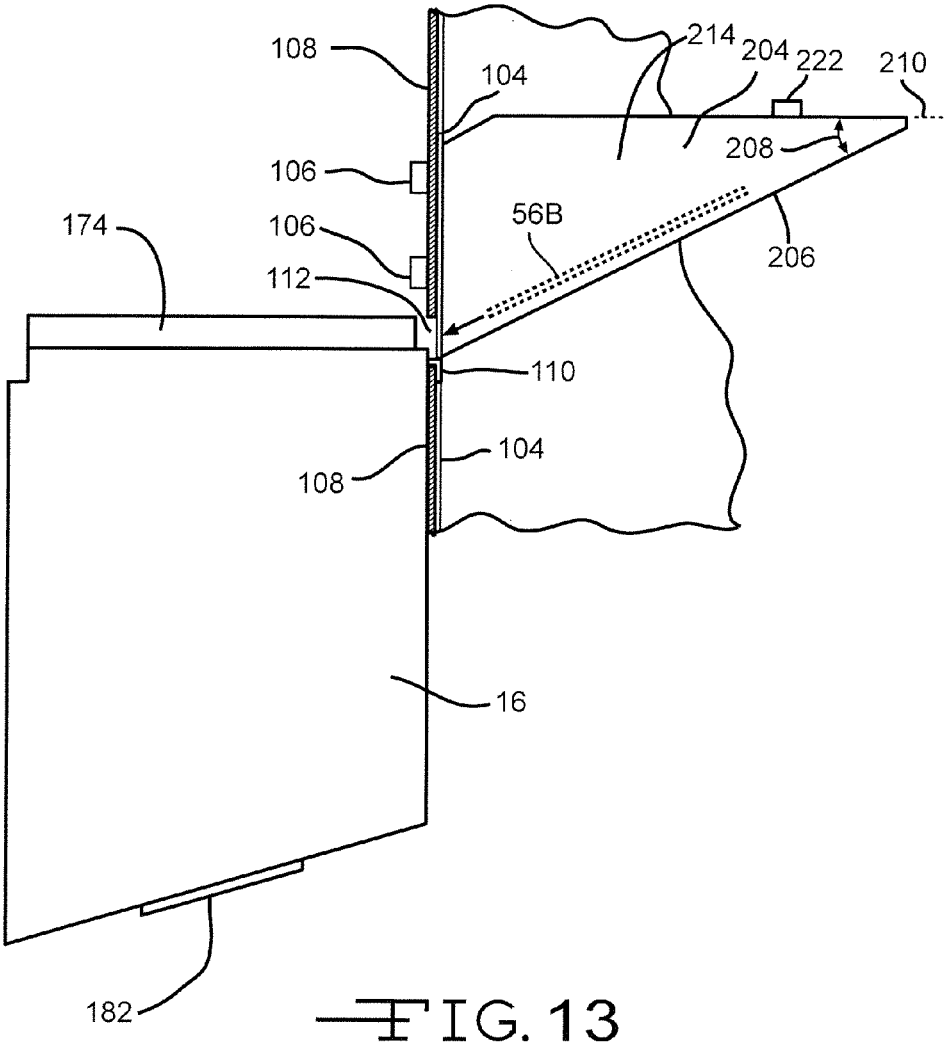
FIG. 13 illustrates a side view of the chute and the hopper of FIG. 12.

FIGS. 12 and 13 illustrate another embodiment showing, respectively, perspective and side views of the hopper 16 and another embodiment of the chute 204 attached to the side-wall 104 of the housing 20 (shown in FIG. 1). Where identical reference numbers have been used for components as were used for the components of the embodiment of FIG. 3, the components are identical. A large portion of the side-wall 104 of the housing 20 (shown in FIG. 1) has been cut-away for illustrative purposes. The chute 204 may be attached to the side-wall 104 of the housing 20 with bolts 106 extending through flanges 107 and 109 of the chute 204. As shown in FIG. 3A, the hopper 16 may be attached to the plate 108 with a hook 110 attached through an opening 112 in the plate 108. A bottom surface 206 of the chute 204 may be angled downward at an angle 208 of 15 degrees from the horizontal plane 210 to cause the marker plate 56B to slide down the chute 204. In other embodiments, the bottom surface 206 of the chute 204 may be angled downward at an angle 208 in a range of 10 to 30 degrees from the horizontal plane 210. The hopper 16 and the divider 174 may be identical to the hopper 16 and the divider 174 of the embodiment shown in FIGS. 3 and 4.

Figure 14:
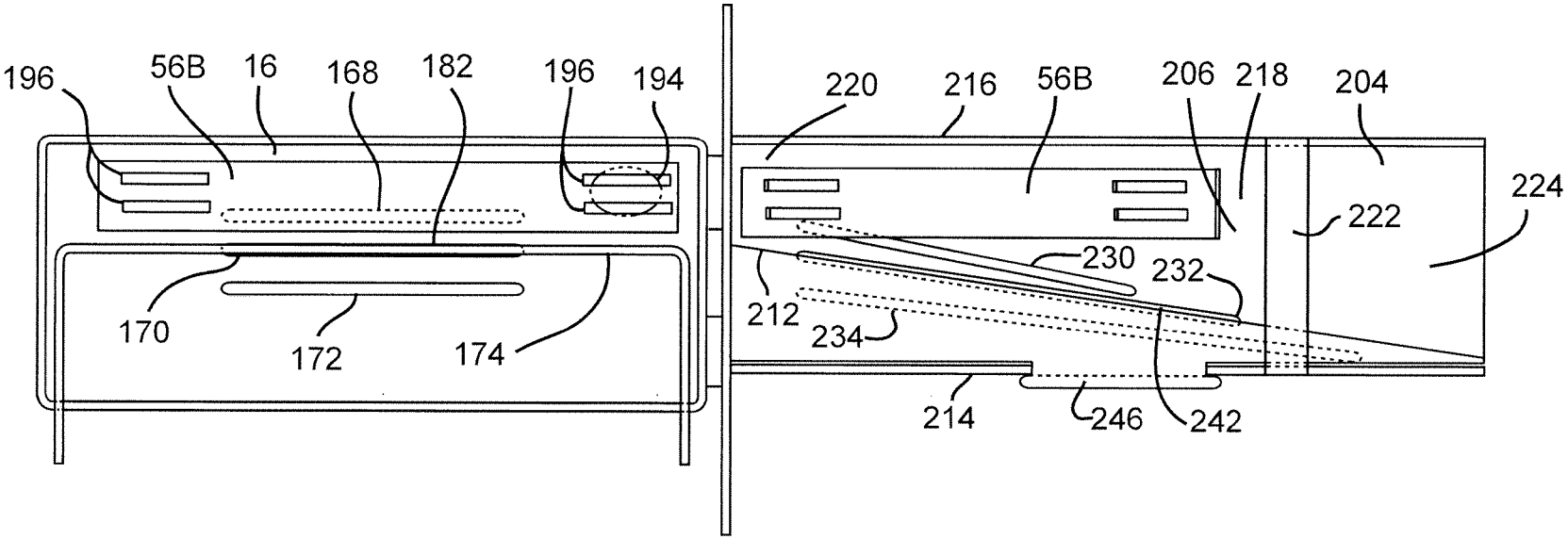
FIG. 14 illustrates a top view of the chute and the hopper of FIG. 12.

FIG. 14 illustrates a top view of the chute 204 and the hopper 16 of FIGS. 12 and 13. As shown in FIG. 14, a substantially linear steel spacer 212 may be disposed within the chute 204. In other embodiments, the spacer 212 may be made of varying rigid materials, such as metal, a composite, or plastic. The spacer 212 may be angled within the chute 204 relative to the parallel side-walls 214 and 216 of the chute 204 to provide a larger entrance area 218 for the marker plate 56B and a smaller exit area 220 for the marker plate 56B. This may make it easier for the chute 204 to catch the marker plate 56B in the entrance area 218 as it falls into the chute 204, but at the same time, force the marker plate 56B to be directed into a more narrow area 220 so that it exits the chute 204 in the desired orientation. An anti-rotation bar 222 may be attached between the side-walls 214 and 216 of the chute 204. The anti-rotation bar 222 will lessen the likelihood that the marker plate 56B will flip over as it falls into the chute 204 between the spacer 212 and the side-wall 216 of the chute 204. If the marker plate 56B bounces up after striking the bottom surface 206 of the chute 204, the marker plate 56B may hit the anti-rotation bar 222 preventing the marker plate 56B from flipping over. This is important as the marker plates 56 need to be delivered to the hopper 16 in the same configuration as they were stacked within the loading device 12.

Figure 15:
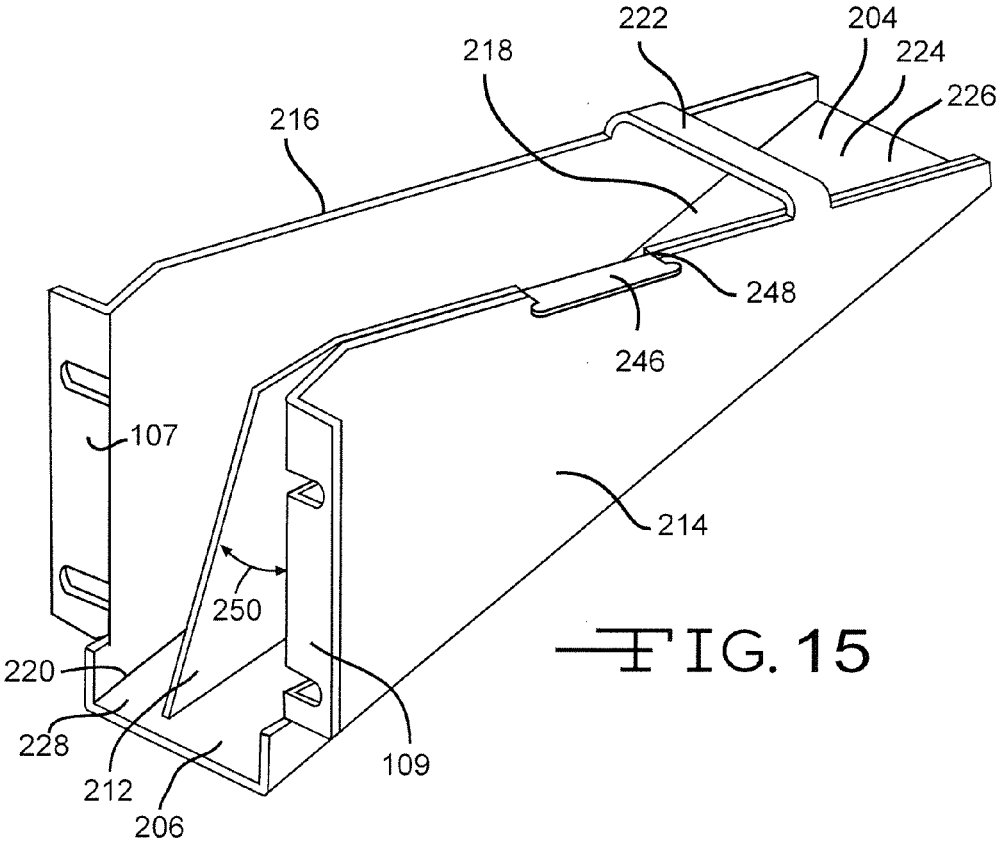
FIG. 15 illustrates a perspective view of the chute of FIG. 12 showing a spacer disposed within the chute.
Figure 16:
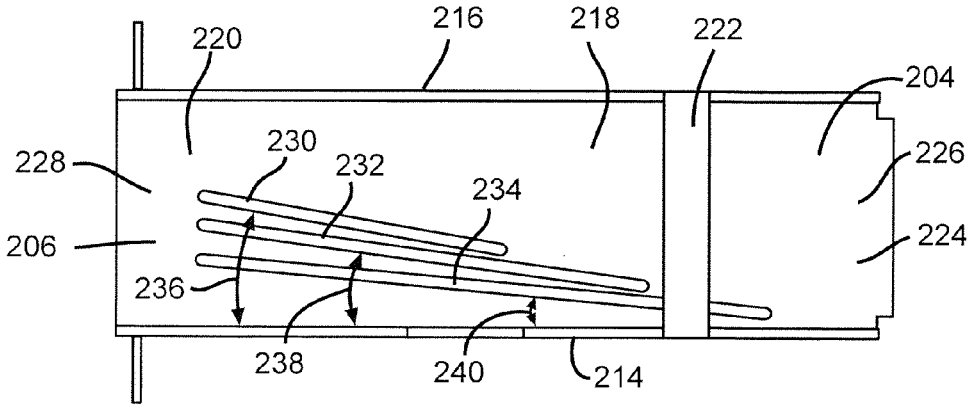
FIG. 16 illustrates a top view of the chute of FIG. 15 with the spacer removed from the chute.

FIG. 15 illustrates a perspective view of the chute 204 with the spacer 212 disposed within the chute 204. FIG. 16 illustrates a top view of the chute 204 with the spacer 212 of FIG. 15 removed from the chute 204. As shown in FIGS. 15-16, the chute 204 may comprise the parallel side-walls 214 and 216, which may be disposed in vertical planes, and the perpendicular bottom surface 206 attached between the parallel side-walls 214 and 216. A trough-like opening 224 may extend between the parallel side-walls 214 and 216 from one side 226 of the chute 204 to another side 228 of the chute 204. The chute 204 may have a U-shape. In other embodiments, the shape of the chute 204 may vary. The bottom surface 206 of the chute 204 may comprise three angled slots 230, 232, and 234 extending at respective angles 236, 238, and 240 to the side-wall 214 of the chute 204. Angles 236, 238, and 240 may comprise, respectively, 4 degrees, 7 degrees, and 8 degrees. In other embodiments, angles 236, 238, and 240 may fall within the respective ranges of 2 to 6 degrees, 6 to 8 degrees, and 8 to 10 degrees. In other embodiments, the bottom surface 206 of the chute 204 may have a varying number of slots 230, 232, and 234 in varying configurations.

Figure 17:
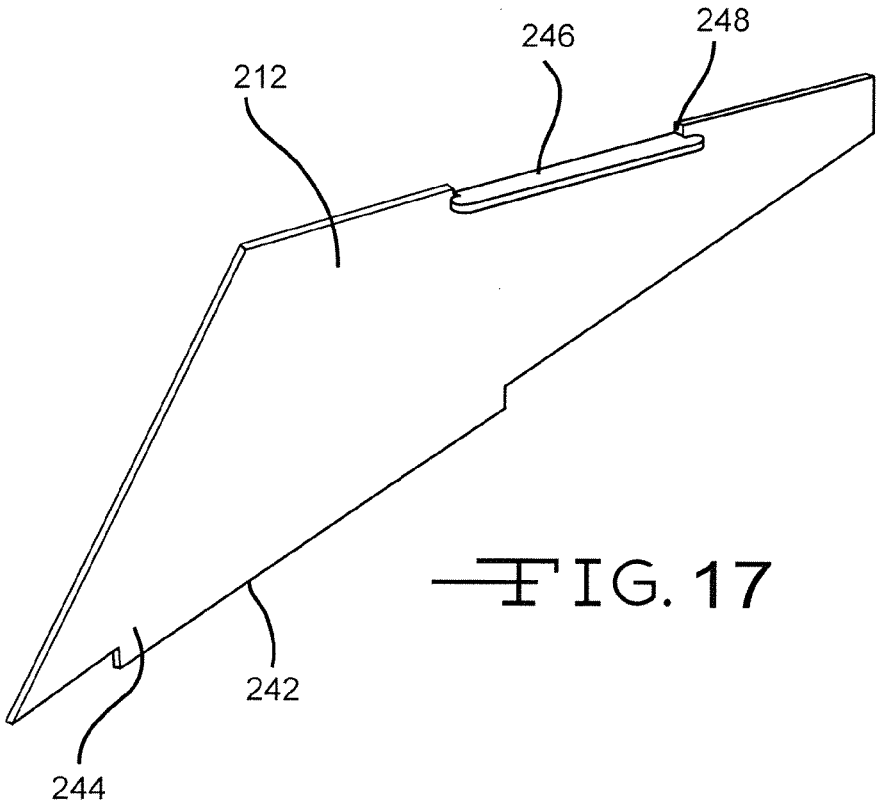
FIG. 17 illustrates a perspective view of the spacer of FIG. 15.

FIG. 17 illustrates a perspective view of the spacer 212. As shown in FIG. 17, the spacer 212 may comprise a substantially linear triangular surface having a tab 242 disposed at one end 244 and a hooked surface 246 disposed at another end 248. As shown in FIGS. 14 and 15, the tab 242 of the spacer 212 may be configured to be disposed in the middle slot 232, while the hooked surface 246 of the spacer 212 may be configured to be secured to a groove 248 in the side-wall 214 of the chute 204. The spacer 212, when disposed in the middle slot 232, may be secured to the chute 204 at an angle 250 relative to the side-wall 214 of the chute 204 to force the marker plate 56B to travel from the larger entrance area 218 to the smaller exit area 220. The angle 250, when the tab 242 of the spacer 212 is disposed in the middle slot 232, between the side-wall 214 of the chute 204 and the spacer 212, may comprise 15 degrees. In other embodiments, the angle 250 between the side-wall 214 of the chute 204 and the spacer 212, when the tab 242 of the spacer 212 is disposed in the middle slot 232, may be in a range of 10 to 20 degrees.

Varying sized spacers 212 in various locations and configurations may be used to accommodate marker plates 56B having varying widths 72 (as shown in FIG. 2). For instance, in one embodiment, the middle slot 232 may be used for a spacer 212 designed to accommodate a 1.37 centimeter (0.54 inch) width marker plate 56B between the spacer 212 and the side-wall 216 of the chute 204. The first slot 230 may be used for a different sized spacer 212 designed to accommodate a 0.95 centimeter (0.375 inch) width marker plate 56B between the spacer 212 and the side-wall 216 of the chute 204. When the tab 242 of the spacer 212 is disposed in the first slot 230, the angle 250 between the side-wall 214 of the chute 204 and the spacer 212 may comprise 20 degrees. In other embodiments, the angle 250 between the side-wall 214 of the chute 204 and the spacer 212, when the tab 242 of the spacer 212 is disposed in the first slot 230, may be in a range of 15 to 25 degrees. The third slot 234 may be used for yet another differently sized spacer 212 designed to accommodate a 1.905 centimeter (0.75 inch) width marker plate 56B between the spacer 212 and the side-wall 216 of the chute 204. When the tab 242 of the spacer 212 is disposed in the third slot 234, the angle 250 between the side-wall 214 of the chute 204 and the spacer 212 may comprise 10 degrees. In other embodiments, the angle 250 between the side-wall 214 of the chute 204 and the spacer 212, when the tab 242 of the spacer 212 is disposed in the third slot 234, may be in a range of 5 to 15 degrees.

Preferably, for each varying sized spacer 212, the distance between the side-wall 216 of the chute 204 and the spacer 212 at the entrance side 218 of the chute 204 is greater than the distance between the side-wall 216 of the chute 204 and the spacer 212 at the exit side 220 of the chute 204. Preferably, the distance between the side-wall 216 of the chute 204 and the spacer 212 at the entrance side 218 of the chute 204 is 100 percent larger than the width 72 of the marker plates 56. In other embodiments, the distance between the side-wall 216 of the chute 204 and the spacer 212 at the entrance side 218 of the chute 204 may be in a range of 50 to 300 percent larger than the width 72 of the marker plates 56. Preferably, the distance between the side-wall 216 of the chute 204 and the spacer 212 at the exit side 220 of the chute 204 is 6 percent larger than the width 72 of the marker plates 56. In other embodiments, the distance between the side-wall 216 of the chute 204 and the spacer 212 at the exit side 220 of the chute 204 may be in a range of 6 to 13 percent larger than the width 72 of the marker plates 56.

Each differently sized spacer 212 may be attached to the chute 204 by inserting the tab 242 of the spacer 212 into the appropriate slot 230, 232, and 234 and securing the hooked surface 246 of the spacer 212 to the groove 248 in the side-wall 214 of the chute 204. In such manner, by inserting varying sized spacers 212 into the differently oriented slots 230, 232, and 234, the distance between the spacer 212 and the side-wall 216 of the chute 204 may be controlled for differently sized marker plates 56B. In other embodiments, any number of slots 230, 232, and 234 oriented in varying locations and configurations may be used in conjunction with any number of varying sized spacers 212 oriented in varying locations and configurations in order to tailor the chute 204 for any desired size marker plate 56B.

One or more embodiments of the disclosure may reduce one or more issues associated with one or more of the prior embossing systems. One or more embodiments of the disclosure may result in one or more of the following: a reduced likelihood of a misfeed in the loading device 12; the capability to emboss any width 72 or thickness 97 marker plates 56; a reduced likelihood of embossed marker plates 56 being delivered in the incorrect stack-order; an easier way to remove the embossed marker plates 56 from the hopper 16 without having the embossed marker plates 56 fall out of the stacked arrangement; or one or more additional improvements.

It should be understood, of course, that the foregoing relates to exemplary embodiments of the disclosure and modifications may be made without departing from the spirit and scope of the disclosure.

We claim:

1. A loading device for a marker plate embossing system comprising:

a base surface;

gate members;

rollers attached to the gate members, the rollers disposed adjacent to the base surface, wherein the gate members each comprise first and second surfaces forming an L-shape, wherein the first L-shaped surface comprises a first end-surface having a hole with one of the rollers rotatably attached to the hole, and the second L-shaped surface comprises a plurality of holes; and opposed frame members, wherein the opposed frame members are attached to the gate members, the gate members being adapted to be locked into a first position relative to the opposed frame members to dispose the rollers at one location relative to the base surface, and the gate members being adapted to be moved into a second position relative to the opposed frame members to dispose the rollers in a different location relative to the base surface.

2. The loading device of claim 1 wherein the rollers are disposed relative to the base surface to only allow one marker plate at a time to be rolled between the base surface and the rollers.

3. The loading device of claim 1 wherein distances between the rollers and the base surface are adjustable to allow the loading device to be used for varying thickness marker plates.

4. The loading device of claim 1 wherein the rollers are made of a flexible material and a bottom surface of the rollers is disposed against the base surface.

5. The loading device of claim 1 further comprising a stabilizing bar attached to the opposed frame members.

6. The loading device of claim 1 further comprising a plate weight positioned between the opposed frame members for placing a weight on a stack of marker plates, wherein the plate weight comprising front and back surfaces, side surfaces, top and bottom surfaces, and tapered protrusions extending from the front and back surfaces at non-parallel angles relative to the front and back surfaces.

7. The loading device of claim 1 further comprising a sizing block positioned between the opposed frame members for aligning width adjustment bars with respect to the gate members, wherein the sizing block comprising a rectangular member having front and back surfaces, side surfaces, and top and bottom surfaces, wherein a width of the sizing block between the front and back surfaces is in a range of between two to ten percent larger than a width of marker plates loaded with the loading device.

8. A loading device for a marker plate embossing system comprising:

a base surface;

gate members;

rollers attached to the gate members, the rollers disposed adjacent to the base surface; and a sizing block positioned adjacent the gate members for aligning width adjustment bars into positioned with respect to the gate members, the sizing block comprising a rectangular member having front and back surfaces, side surfaces, and top and bottom surfaces, wherein a width of the sizing block between the front and back surfaces is in a range of between two to ten percent larger than a width of marker plates loaded with the loading device.

9. The loading device of claim 8 wherein the rollers are disposed relative to the base surface to only allow one marker plate at a time to be rolled between the base surface and the rollers.

10. The loading device of claim 8 wherein distances between the rollers and the base surface are adjustable to allow the loading device to be used for varying thickness marker plates.

11. The loading device of claim 8 wherein the rollers are made of a flexible material and a bottom surface of the rollers is disposed against the base surface.

12. The loading device of claim 8 wherein the gate members each comprise first and second surfaces forming an L-shape, wherein the first L-shaped surface comprises a first end-surface having a hole with one of the rollers rotatably attached to the hole, and the second L-shaped surface comprises a plurality of holes.

13. The loading device of claim 8 further comprising a plate weight positioned between the gate members for placing a weight on a stack of marker plates, wherein the plate weight comprising front and back surfaces, side surfaces, top and bottom surfaces, and tapered protrusions extending from the front and back surfaces at non-parallel angles relative to the front and back surfaces.

14. A loading device for a marker plate embossing system comprising:

a base surface;

gate members;

rollers attached to the gate members, the rollers disposed adjacent to the base surface;

opposed frame members, wherein the opposed frame members are attached to the gate members, the gate members being adapted to be locked into a first position relative to the opposed frame members to dispose the rollers at one location relative to the base surface, and the gate members being adapted to be moved into a second position relative to the opposed frame members to dispose the rollers in a different location relative to the base surface; and a plate weight positioned between the opposed frame members for placing a weight on a stack of marker plates, wherein the plate weight comprising front and back surfaces, side surfaces, top and bottom surfaces, and tapered protrusions extending from the front and back surfaces at non-parallel angles relative to the front and back surfaces.

* * * * *